US007224922B2

(12) United States Patent
Kemmochi

(10) Patent No.: US 7,224,922 B2
(45) Date of Patent: May 29, 2007

(54) IMAGE FIXING APPARATUS CAPABLE OF CHANGING SURFACE CONDITION OF FIXING ROTARY MEMBER AND FIXING ROTARY MEMBER FOR USE THEREIN

(75) Inventor: Kazuhisa Kemmochi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 11/058,253

(22) Filed: Feb. 16, 2005

(65) Prior Publication Data

US 2005/0185978 A1 Aug. 25, 2005

(30) Foreign Application Priority Data

Feb. 20, 2004 (JP) ..... 2004-044505
Feb. 10, 2005 (JP) ..... 2005-034838

(51) Int. Cl.
*G03G 15/00* (2006.01)
*G03G 15/20* (2006.01)

(52) U.S. Cl. ..... 399/109; 399/320; 399/328; 399/333

(58) Field of Classification Search ..... 399/109, 399/320, 327, 328, 333, 341
See application file for complete search history.

(56) References Cited

U.S. PATENT DOCUMENTS

| | | | | |
|---|---|---|---|---|
| 4,970,219 | A | 11/1990 | Effland et al. | 514/339 |
| 4,983,615 | A | 1/1991 | Effland et al. | 514/337 |
| 5,019,869 | A * | 5/1991 | Patton | 399/320 |
| 5,034,403 | A | 7/1991 | Effland et al. | 514/338 |
| 5,083,168 | A | 1/1992 | Kusaka et al. | |
| 5,162,634 | A | 11/1992 | Kusaka et al. | 219/216 |
| 5,221,682 | A | 6/1993 | Effland et al. | 514/349 |
| 5,262,834 | A | 11/1993 | Kusaka et al. | 355/285 |
| 5,405,856 | A | 4/1995 | Effland et al. | 514/349 |
| 5,999,788 | A | 12/1999 | Kanesawa et al. | 399/329 |
| 6,078,780 | A | 6/2000 | Abe et al. | 399/328 |
| RE36,962 | E | 11/2000 | Higashi et al. | 399/328 |
| 6,763,205 | B2 | 7/2004 | Izawa et al. | 399/69 |
| 2005/0036809 | A1 | 2/2005 | Fukita et al. | 399/328 |

FOREIGN PATENT DOCUMENTS

| | | |
|---|---|---|
| JP | 2-157878 | 6/1990 |
| JP | 6-318001 | 11/1994 |
| JP | 9-44014 | 2/1997 |
| JP | 9-305058 | 11/1997 |
| JP | 11-133776 | 5/1999 |
| JP | 2001-22219 | 1/2001 |
| JP | 2003-186327 | 7/2003 |

* cited by examiner

*Primary Examiner*—William J. Royer
(74) *Attorney, Agent, or Firm*—Fitzpatrick, Cella, Harper & Scinto

(57) ABSTRACT

A fixing apparatus including a rotatable member, a heater for heating the rotatable member, and control means which controls heat generation of the heater, wherein a toner image on a recording material is heated by the rotatable member, the apparatus has a surface condition changing mode for changing a surface condition of the rotatable member, and, when the surface condition changing mode is selected, the control means controls the heat generation of the heater in such a manner that a surface temperature of the rotatable member becomes equal to or higher than a melting temperature of a surface layer of the rotatable member.

16 Claims, 17 Drawing Sheets

FIXING OPERATION (1)

SURFACE PROFILE FORMING OPERATION (2)

(IV)
(SPACING STATE)

(V)
(SURFACE PROFILE FORMING STATE)

(VI)
(COOLING STATE)

SURFACE CONDITION CHANGING OPERATION (A)

FIXING OPERATION (B)

IMAGE FIXING APPARATUS CAPABLE OF CHANGING SURFACE CONDITION OF FIXING ROTARY MEMBER AND FIXING ROTARY MEMBER FOR USE THEREIN

BACKGROUND OF THE INVENTION

1. Field of the Invention

The present invention relates to an image fixing apparatus to be mounted on an image forming apparatus such as a copying apparatus or a printer, and a fixing rotary member for use in such image fixing apparatus.

2. Related Background Art

In a copying apparatus or a printer of an electrophotographic method, there is provided a fixing apparatus for heat fixing a toner image formed on a recording material. The fixing apparatus is available in various types such as a heat roller type for heat fixation by nipping and conveying the recording material with a fixing roller heated by an internally provided halogen lamp and a pressure roller, an on-demand type (also called film heating type) in which a ceramic heater is contacted with an internal surface of a flexible sleeve (fixing film or fixing belt) based on a heat-resistant resin or a metal and heats the recording material through the flexible sleeve, an electromagnetic induction heating type in which a rotary member itself in contact with the recording material generates heat and, in any type, a rotary member such as a fixing roller or a flexible sleeve is usually provided, on the surface thereof, with a releasing layer. Such releasing layer suppresses an offsetting of the toner to the rotary member. The releasing layer is required to have a heat resistant property and a releasing property, and such properties can be satisfied by fluorinated resins such as polytetrafluoroethylene (hereinafter also represented as PTFE), a perfluoroalkyl vinyl ether-tetrafluoroethylene copolymer (hereinafter also represented as PFA), and a hexafluoropropylene-tetrafluoroethylene copolymer (hereinafter also represented as FEP), which are widely employed for the releasing layer of the fixing rotary member.

Though the fluorinated resin has excellent heat-resistance property and releasing property and is commonly employed in the releasing layer of the fixing rotary member, it has a relatively high hardness because of its high melting point (for example PFA has a melting point of about 300° C.). In order to achieve satisfactory fixation of the toner, it is necessary, In addition to appropriate heating and pressurizing on the toner, to wrap up the toner by the fixing rotary member. In order to obtain a wrapping state for the toner, the fixing rotary member is required to have an approximate elasticity, and the fluorinated resin, having a relatively high hardness as mentioned above, is required to be provided thin in case of use as the releasing layer of the fixing rotary member.

However, an excessively thin releasing layer has a drawback of being easily broken, and is naturally insufficient in durability. Also a releasing layer of even an appropriate thickness is subjected to a loss in service life, not only by a long-term deterioration such as a surface roughening of the releasing layer during long-term use, but also by damage on the releasing layer by a separating claw for separating the recording material from the fixing rotary member or by damage on the releasing layer by the recording material when it is jammed In the vicinity of the fixing apparatus. The damage on the releasing layer by these factors is transferred onto the toner image at the fixing step, thereby deteriorating the image quality. Consequently, the damaged fixing rotary member has to be replaced.

On the other hand, in recent image forming apparatus, particularly in full-color image forming apparatus, there is required a function of varying a gloss (luster) of an image outputted from the apparatus. For varying the gloss in the fixing apparatus, there is known a method of suitably regulating a fixing temperature, a process speed (fixing speed), and a pressure etc. (for example Japanese Patent Application Laid-open Nos. H9-305058 and 2001-22219)

In a full-color image forming apparatus, there is required a satisfactory color reproducibility in the output image, and, for improving the color reproducibility, there are required conditions of a stable toner fusion state, an improved transparency of the toner image after fixation, and a sufficient mixing of toner. These conditions are not limited to a full-color image but also applicable to a monochromatic image.

However, a gloss control by varying the fixing temperature or the fixing speed as described in Japanese Patent Application Laid-open No. H9-305058 results in a change in the toner fusion state. Stated differently, a change in the surface condition of the toner image can regulate the gloss but also varies the fusion state not only on the surface but also inside the toner layer. For example, an increase in the gloss progresses the fusion inside the toner layer (for example the transparency of the 25 reS1n itself of the toner layer is elevated, and the color mixing of the toner layer is progressed). On the other hand, a decrease in the gloss suppresses the fusion inside the toner layer (for example the transparency of the resin of the toner layer is not elevated, and the color mixing of the toner layer is not progressed).

In order to increase the variation range of the gloss by the method described in Japanese Patent Application Laid-open No. H9-305058, it is necessary to increase a regulation range of the fixing temperature and the fixing speed, but, in such case, the toner layer shows a large difference in the fusion state between a high-gloss state and a low-gloss state, and the color reproducibility has to be sacrificed since a cold offset limit is present at the low gloss side and a hot offset limit is present at the high gloss side. On the other hand, in order not to sacrifice the color reproducibility, the regulation range for the fixing temperature and the fixing speed has to be made smaller. Therefore, in this method, it is in fact not possible to increase the regulation range of the gloss control.

On the other hand, Japanese Patent Application Laid-open No. 2001-22219 describes a method for controlling the gloss by varying a pressure. However, a method of varying the gloss by regulating the pressure also affects the transparency of the resin itself of the toner layer, as a press-out level of air layers present between the toner particles present in the toner layer varies by the pressure. Also depending on the type of the recording material, a toner penetration between fibers of paper is also influenced. For example, in case of obtaining a low-gloss image, there is selected a low pressure to reduce the toner penetration into the paper fibers, while, in a case of obtaining a high-gloss image, there is selected a high pressure to increase the toner penetration into the paper fibers, so that the color reproducibility is sacrificed. In order not to sacrifice the color reproducibility, the regulation range for the pressure has to be made smaller. Therefore, also in this method, it is in fact not possible to increase the regulation range of the gloss control.

Also it is known that a surface condition of the fixing rotary member in contact with the toner image influences the gloss, but, in order to vary the gloss of an image, it is necessary to employ, each time, a fixing rotary member of a different surface condition or a fixing apparatus having such fixing rotary member, and the gloss cannot be controlled in practice.

As explained in the foregoing, the gloss control methods proposed conventionally are unable to achieve a color reproducibility of an image and a gloss control of a large regulation range at the same time.

SUMMARY OF THE INVENTION

The present invention has been made in consideration of the aforementioned drawbacks, and an object of the present invention is to provide a fixing apparatus capable of varying a surface condition of a fixing rotary member, and a fixing rotary member for use in such fixing apparatus.

Another object of the present invention is to provide a fixing apparatus capable of restoring a surface of a fixing rotary member, and a fixing rotary member for use in such fixing apparatus.

Still another object of the present invention is to provide a fixing apparatus capable of controlling a gloss of a toner image, and a fixing rotary member for use in such fixing apparatus.

Still another object of the present invention is to provide a fixing apparatus capable of selecting a large regulation range of a gloss control, and a fixing rotary member for use in such fixing apparatus.

Still another object of the present invention is to provide a fixing apparatus capable of achieving a color reproducibility of an image and a gloss control of a large regulation range at the same time, and a fixing rotary member for use in such fixing apparatus.

Still another object of the present invention is to provide a fixing apparatus capable of controlling a gloss of a toner image without replacing a fixing rotary member, and a fixing rotary member for use in such fixing apparatus.

Still another object of the present invention is to provide a fixing apparatus including:

a rotatable member;

a heater for heating the rotatable member; and control means which controls a heat generation of the heater;

wherein a toner image on a recording material is heated by the rotatable member;

the apparatus has a surface condition changing mode for changing a surface condition of the rotatable member, and, when the surface condition changing mode is selected, the control means controls the heat generation of the heater in such a manner that a surface temperature of the rotatable member 20 becomes equal to or higher than a melting temperature of a surface layer of the rotatable member.

Still another object of the present invention is to provide a fixing rotary member including:

a base layer; and a surface layer constituted of a thermoplastic resin having a melting point of 250° C. or higher.

Still other objects of the present invention will become fully apparent from the following detailed description, which is to be taken in conjunction with the accompanying drawings.

DETAILED DESCRIPTION OF THE PREFERRED EMBODIMENTS

In the following, the present invention will be explained in detail with reference to the accompanying drawings.

Embodiment 1

(1) Example of Image Forming Apparatus

Figure 1:
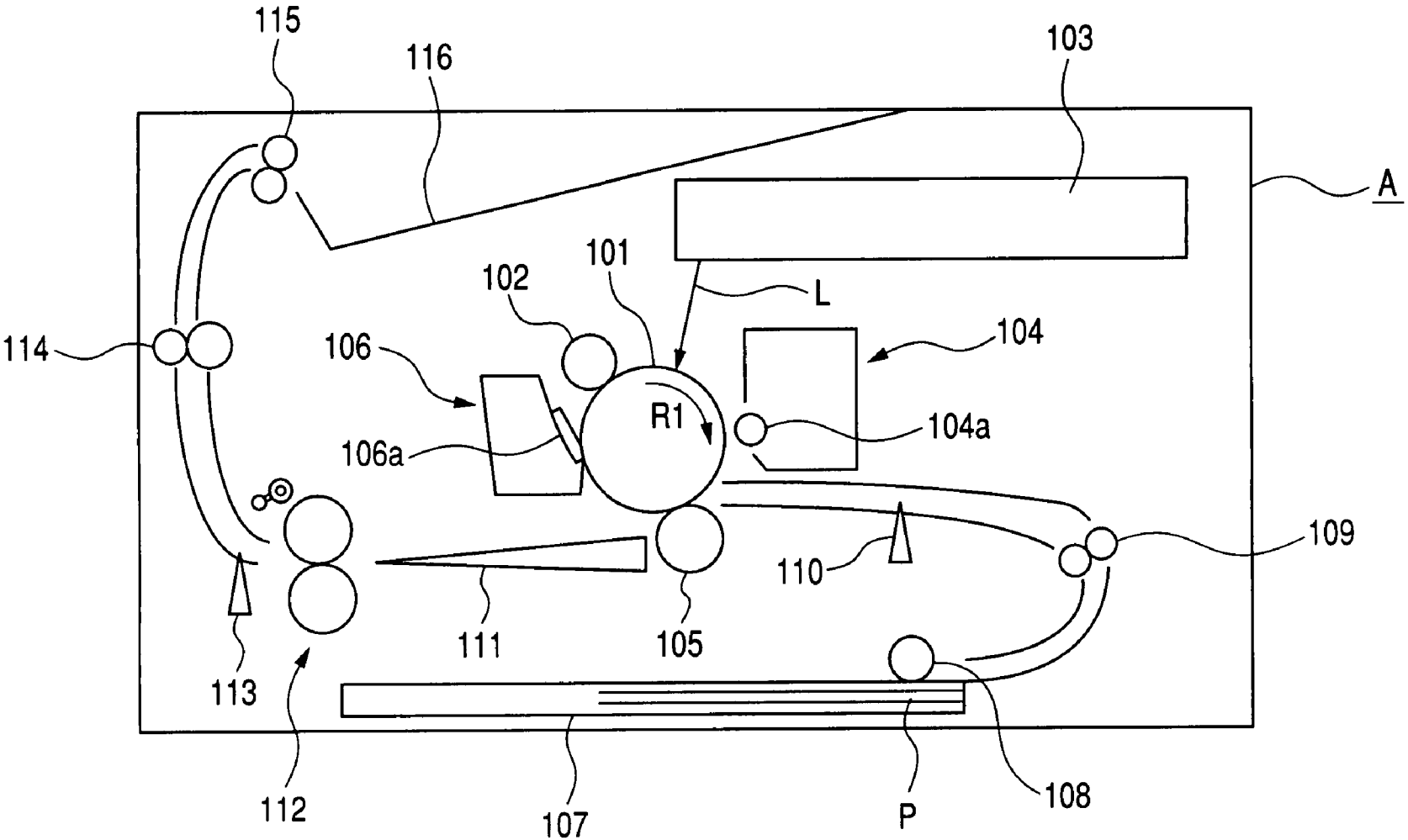
FIG. 1 is a schematic view showing a configuration of an image forming apparatus provided with a fixing apparatus of the present invention.

FIG. 1 shows an image forming apparatus equipped with a fixing apparatus of the present invention. The image forming apparatus of the present embodiment is a laser beam printer utilizing an electrophotographic process of transfer type. The image forming apparatus of the present embodiment is provided with a drum-shaped electrophotographic photosensitive member (hereinafter represented as a photosensitive drum) 101 serving as an image bearing member. The photosensitive drum 101 is rotatably supported by a main body A of the apparatus, and is rotated by driving means (not shown) in a direction R1 at a predetermined process speed. Along the periphery of the photosensitive drum 101, there are provided, In the order along the rotating direction, a charging roller (charging means) 102, an exposure apparatus 103, a developing apparatus (developing means) 104, a transfer roller (transfer means) 105, and a cleaning apparatus 106. In a lower part of the main body A of the apparatus, a sheet cassette 107 containing a sheet-shaped recording material P such as paper is provided, and there are provided, in an order from the upstream side along a conveying path for the recording material P, a sheet feeding roller 108, conveying rollers 109, a top sensor 110, a conveying guide 111, a fixing apparatus 112 of the invention, sheet discharge sensor 113, a conveying rollers 114, sheet discharge rollers 115 and a sheet discharge tray 116.

The photosensitive drum 101 rotated in the direction R1 by the driving means is uniformly charged by the charging roller 102 at a predetermined polarity and a predetermined potential. The photosensitive drum 101 after the charging is subjected, on the surface thereof, to an image exposure L based on image information by the exposure apparatus 103 such as a laser optical system to dissipate the charge in an exposed portion thereby forming an electrostatic latent image. The electrostatic latent image is developed by the developing apparatus 104. The developing apparatus 104 is equipped with a developing roller 104*a*, which, under an application of a developing bias voltage, deposits a toner onto the electrostatic latent image on the photosensitive drum 101 thereby obtaining a visible toner image. The toner image is transferred by the transfer roller 105 onto a recording material P such as paper.

The recording material P contained in the sheet cassette 107 is fed by the feeding roller 108, conveyed by the conveying rollers 109 and further conveyed through the top sensor 110 to a transfer portion between the photosensitive drum 101 and the transfer roller 105. In this operation, the recording material P is detected at a leading end thereof by the top sensor 110, and is synchronized with the toner image on the photosensitive drum 101. The transfer roller 105 is given a transfer bias, whereby the toner image on the photosensitive drum 101 is transferred onto a predetermined position on the recording material P as an unfixed image.

The recording material P bearing the transferred unfixed toner image on the surface is conveyed along the conveying guide 111 to the fixing apparatus 112 in which the unfixed toner image is subjected to heat and pressure and is fixed to the surface of the recording material P.

The recording material P after the toner image fixation is conveyed by the conveying rollers 114 and is discharged by the discharge rollers 115 onto the discharge tray 116 of the main body A of the apparatus.

On the other hand, the photosensitive drum 101 after the toner image transfer to the recording material P is subjected to a cleaning of the toner, remaining on the surface without being transferred onto the recording material P, by a cleaning blade 106*a* of the cleaning apparatus 106, and is used again for a next image formation.

Image formation can be executed in succession by repeating the above-described operations.

2) Fixing Apparatus (Image Fixing Apparatus)

Figure 2:
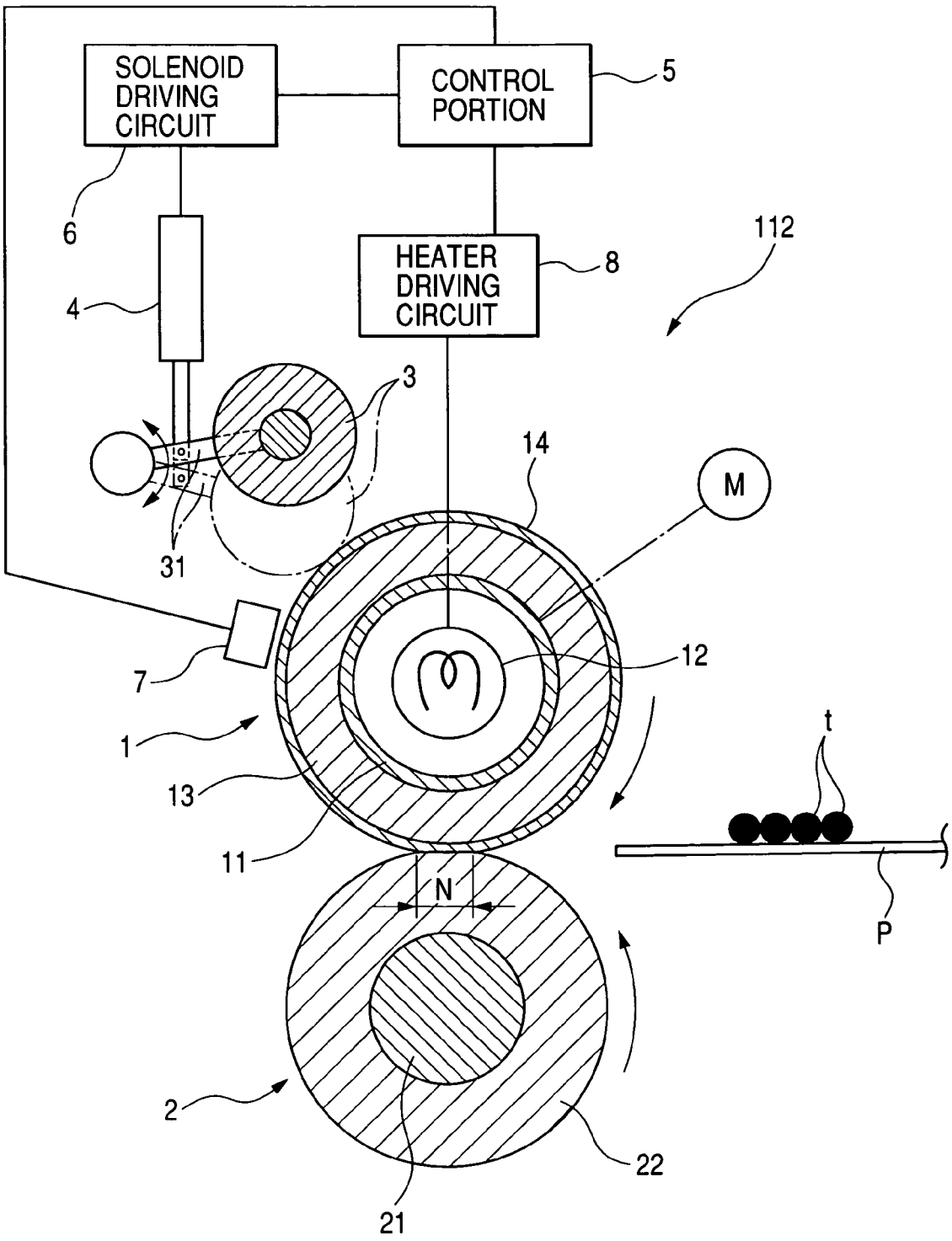
FIG. 2 is a schematic view showing a configuration of a fixing apparatus of embodiment 1.

FIG. 2 is a schematic view showing the configuration of the fixing apparatus 112. The fixing apparatus 112 of the present embodiment is a fixing apparatus of heat roller type, provided with a fixing roller 1 constituting a fixing rotary member. and a pressure roller 2 constituting a pressurizing member, which are mutually pressed to form a fixing nip portion N, wherein the fixing roller 1 is heated by an internal heater 12 and the recording material P bearing a toner image t is nipped and conveyed by the fixing nip portion N to fix the toner image t onto the recording material P. A numeral 3 indicates a surface shape improving member (surface condition changing member). As will be explained later, the fixing apparatus 112 of the present embodiment has a function of heating the surface of the fixing roller to or higher than a melting point or a releasing layer on the surface of the fixing roller 1 and contacting the surface condition changing member having a mirror-finished surface in this state thereby repairing damage on the surface of the fixing roller 1.

1) Fixing Roller (Fixing Rotary Member)

The fixing roller 1 for example has an external diameter of 40 mm and a length of 240 mm and is constituted of a cylindrical metal core (base layer) 11 of a thickness of 2.5 mm, in which the heater 12 (such as a halogen heater of 490 W/127 V) is provided as a heat source and on which an elastic layer 13 and a surface releasing layer 14 as a surface layer are laminated.

The elastic layer 13 is not particularly restricted as long as it is principally constituted of rubber of a low hardness. The low-hardness rubber may be selected arbitrarily, but is advantageously constituted of a vulcanized rubber such as HVR (heat vulcanized silicone rubber), LSR (liquid silicone rubber) or LTV (low-temperature vulcanized silicone rubber).

The elastic layer 13 may contain, if necessary, a filler ordinarily added to silicone rubber, such as fumed silica, precipitation silica, hydrophobicized silica, carbon black, titanium dioxide, ferric oxide, aluminum oxide, magnesium oxide, zinc oxide, quartz powder, diatomaceous earth, calcium silicate, talc, bentonite, asbestos, glass fibers, or organic fibers. In consideration of heat resistance and mechanical strength, there are preferred inorganic fillers such as red iron oxide, black iron oxide, cerium oxide or silica.

The surface releasing layer 14 of the fixing roller 1 is formed by a thermoplastic material having a lower melting point than in an ordinary material employed in the releasing layer, such as PFA. There can be employed any material that can be deformed by heating to the melting point or higher and that has a releasing property, but, in case the melting point is high as in case of PFA, there is required a very high surface temperature in order to attain a state capable of changing the surface condition. A heating of the fixing roller 1 to 300° C. or higher may damage the elastic layer 13 (for example silicone rubber layer) of the fixing roller 1 or may cause damage in other components of the fixing apparatus 112. The melting point of the surface releasing layer 14 is not particularly restricted as 25 long as it is higher than the melting point of the toner, preferably a fixing temperature of the toner/but is preferably 250° C. or less in practice. Also another material may be mixed within a range not deteriorating the function of the surface releasing layer 14. For example an additive for improving thermal conductivity may be mixed. A specific example of the surface releasing layer can be a thermoplastic fluorinated resin Dyneon™THV manufactured by Sumitomo-3M Co.

2) Pressure Roller

The pressure roller is formed with an external diameter and a length approximately the same as those of the fixing roller 1, and is provided, around a solid metal core 21, with an elastic layer 22 of a material similar to that of the fixing roller 1. The pressure roller 2 is provided under and parallel to the fixing roller 1, and is rotatably supported by unillustrated support members provided on both ends in the longitudinal direction of the metal core 21. The support members have pressure springs (biasing means) by which the pressure roller is pressed to the fixing roller 2 under a predetermined pressure to form the fixing nip portion N of a predetermined width with the fixing roller 1. The support members are rendered capable of rotation for contacting or spacing the pressure roller 2 with or from the fixing roller 1, and, in a surface profile forming operation (surface condition changing operation) to be explained later, the support members are rotated by a suitable mechanism or apparatus in a spacing direction of the pressure roller 2 to space the pressure roller 2 from the fixing roller 1.

3) Surface Profile Improving Member (Surface Condition Changing Member)

A surface profile improving member 3 of the present embodiment is maintained in contact with the surface of the fixing roller 1 thereby improving a surface profile (surface condition) thereof. The surface profile improving member 3 is provided in advance with a surface condition required for the surface condition of the fixing roller 1 for example by a mirror finishing, and is preferably formed by a metal roller having a strength, such as of stainless steel. The surface profile improving member 3 of the present embodiment is formed by a metal roller having a smaller external diameter than the fixing roller 1 and an axial length approximately equal to that of the fixing roller 1, and is rotatably supported, on both longitudinal ends, by a rotatable support member 31. The support member 31 is linked with drive means such as a solenoid 4, and, In a surface profile forming operation (surface condition changing operation) to be explained later, a control portion (control means) 5 constituted of a CPU and a memory such as a ROM or a RAM controls a solenoid driving circuit 6 to on/off control the solenoid 4 whereby the surface profile improving member 3 executes operations of contacting with or spacing from the surface of the fixing roller 1. Thus, the fixing apparatus 112 of the present embodiment has a surface condition changing mode for changing the surface condition of the fixing rotary member 1.

4) Explanation of Function

In the present embodiment, the fixing roller 1 is characterized in that the surface releasing layer 14 is formed by a thermoplastic material capable of attaining a deformable state (surface condition changeable state) by a heat supply, particularly a material having a lower melting point thin in a material ordinarily employed in the releasing layer, such as PFA. Also the fixing apparatus 112 is capable of executing (1) a fixing operation in a temperature range in which the surface condition of the surface releasing layer 14 of the fixing roller 1 scarcely changes, and (2) a surface profile forming operation (surface condition changing operation) In a temperature range in which the surface condition of the surface releasing layer 14 can be changed In the present embodiment, "deformation of surface releasing layer" means a deformation by thermoplasticity, and does not mean an elastic deformation at a temperature at or lower than the melting point, where the thermoplastic state is not reached.

In (1), as the surface releasing layer 14 is in a surface condition substantially uninfluenced by a member contacting the releasing layer (for example pressure roller 2), it can execute heat-pressure fixation by fusing and crushing the toner t the same as or better than a prior surface releasing layer such as of PFA (details being given later).

In (2), as the surface releasing layer 14 is in a surface condition that can be influenced by a member contacting the releasing layer 14, the surface profile of the surface releasing layer 14 can be repaired by a contact for example with a surface condition improving member 3.

Figure 3:
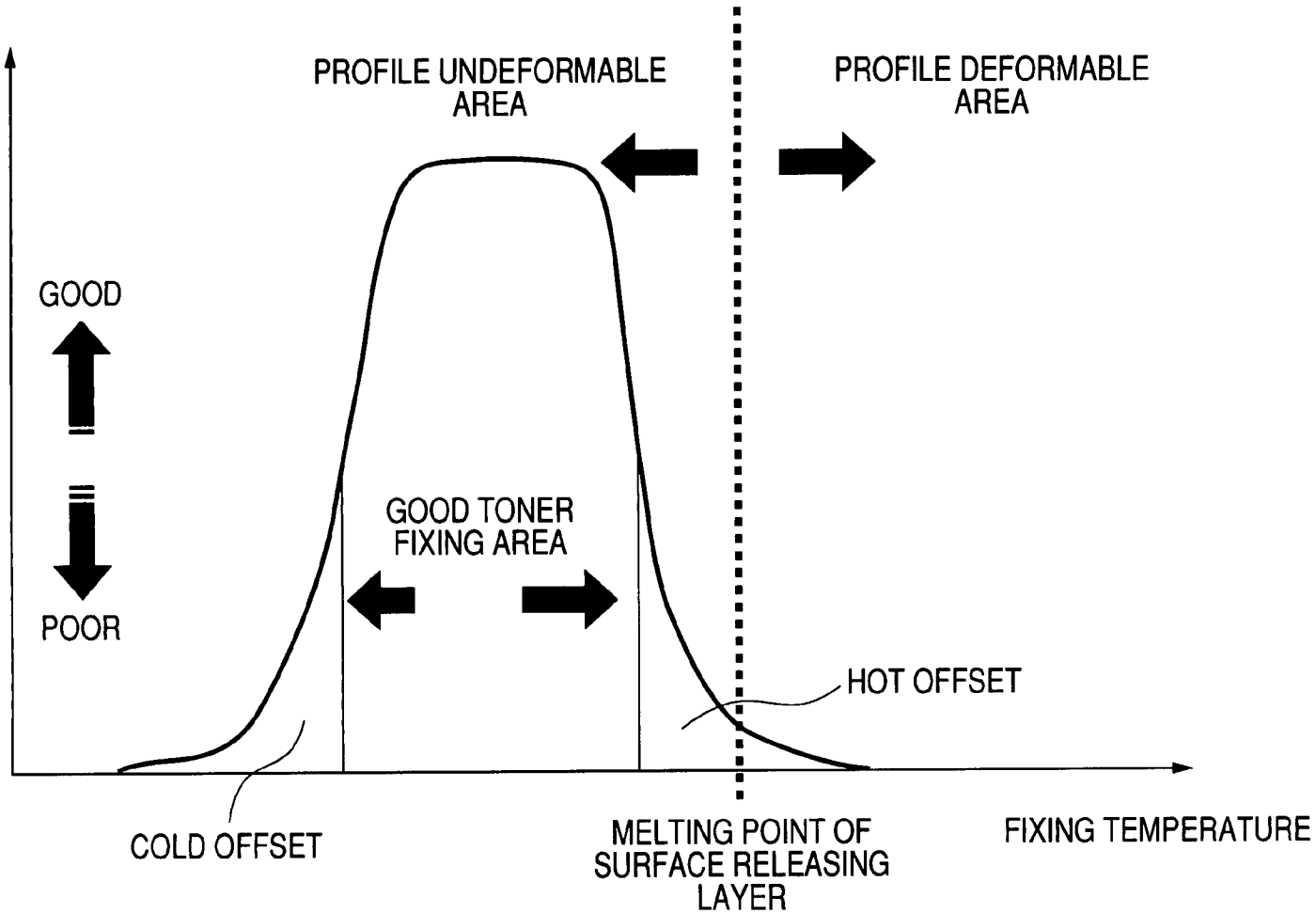
FIG. 3 is a chart showing a relationship between a melting point of a surface releasing layer in a fixing rotary member of the present invention and a toner fixing temperature.

FIG. 3 shows temperature areas in which a profile change (condition change) of the thermoplastic releasing layer 14 of the fixing roller 1 is enabled or disabled and the function of the fixing apparatus 112 is executed, together with a fixing area of the toner to be used.

In the surface temperature of the fixing roller shown in FIG. 3, by selecting the melting point of the surface releasing layer 14 higher than a good toner fixing area between a cold offset area and a hot offset area for the toner to be used, a temperature range lower than the melting point of the surface releasing layer 14 constitutes a profile undeformable area, in which a fixing operation as in the prior art can be executed by the aforementioned fixing operation (1).

Also a temperature range higher than the melting point of the surface releasing layer 14 constitutes a profile deformable area, in which the aforementioned surface profile forming operation (2) can be executed and then a fixing operation as in the prior art can be executed by the aforementioned fixing operation (1).

Within such two operations, the fixing operation (1) is repeated in a normal state for fixing a toner image, but, in case the surface releasing layer 14 is subjected to any damage in the profile (condition) thereof, the surface condition of the surface releasing layer 14 can be restored by executing the aforementioned surface profile forming operation (2), and then the fixing operation (1) can be executed In a normal state for fixing a toner image.

a) Fixing Operation (1)

Figure 4A:
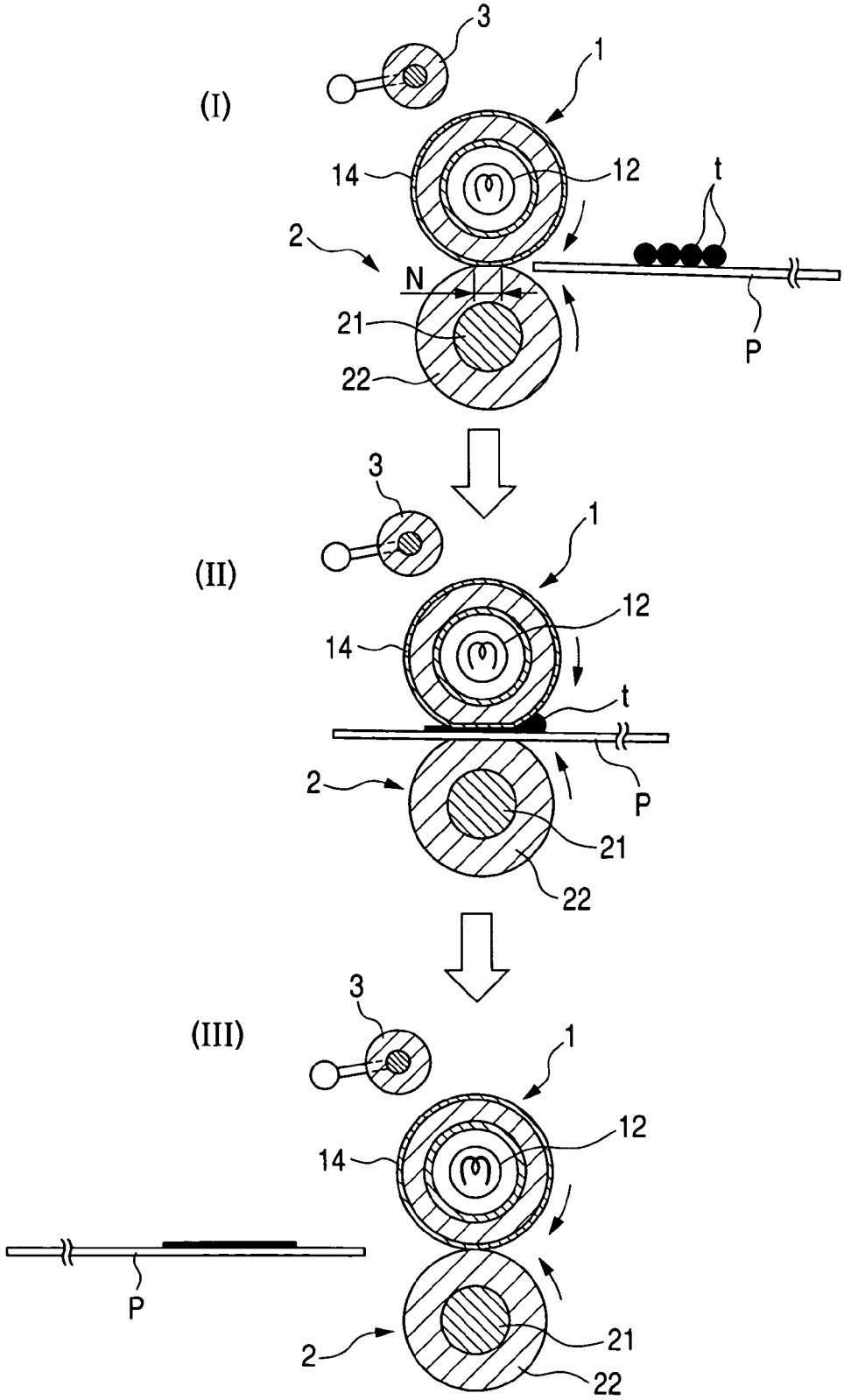
FIG. 4A is a view showing a fixing operation in the fixing apparatus of embodiment 1.
Figure 4B:
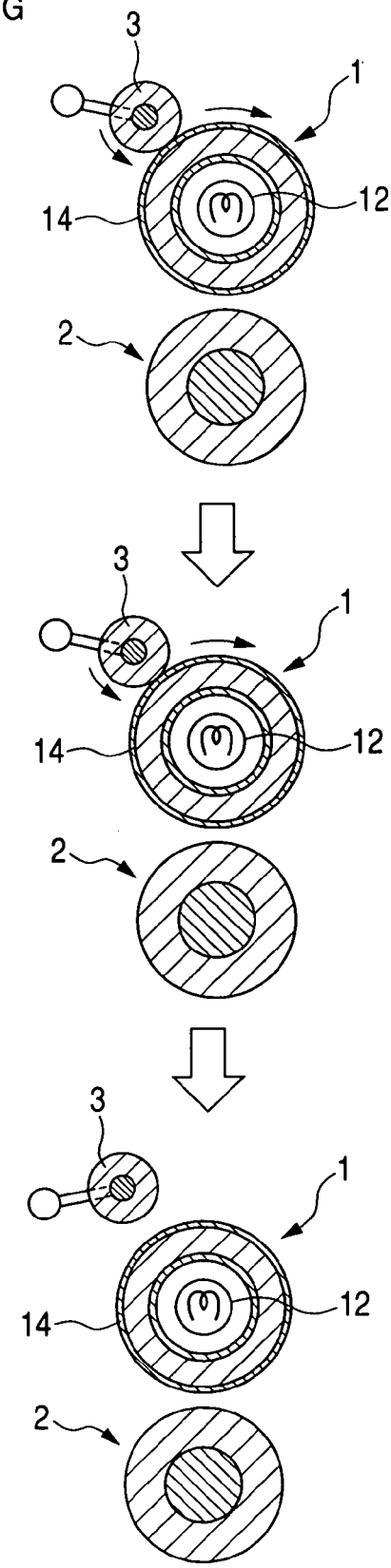
FIG. 4B is a view showing a surface condition changing operation of a fixing roller in the fixing apparatus of embodiment 1.

FIG. 4A shows a fixing operation (1), which is executed by a control portion 5 according to a fixing operation program (fixing operation mode) stored in a memory of the control portion 5.

Based on a surface temperature of the fixing roller 1 detected by a temperature detector (temperature detection means) 7 positioned in non contact with the surface of the fixing roller 1, the control portion 5 executes an on/off control on the heater driving circuit 8 thereby controlling power supply to the heater 12. Such heat generation control of the heater controls the temperature of the fixing roller 1 in such a manner that the surface temperature thereof becomes a temperature control target temperature (first set temperature) of a fixing step. The first set temperature is higher than the melting point of the toner and is lower than the melting point of the releasing layer 14 of the fixing roller 1. The temperature detector 7 may be contacted in the fixing operation with the surface of the fixing roller 1 by an arbitrary mechanism or apparatus, but, in the surface profile forming operation (surface condition changing operation) of the fixing roller 1, is spaced from the roller surface in order to prevent damage on the roller surface.

After the surface temperature of the fixing roller 1 reaches a temperature control target temperature (hereinafter represented as fixing temperature), the fixing roller 1 is rotated clockwise, as indicated by an arrow, by a driving system M, while the pressure roller 2 is rotated counterclockwise by the rotation of the fixing roller 1 and, when a recording material P bearing an unfixed toner image (unfixed image) t is introduced into the nip portion N, nips and conveys the recording material P in cooperation with the fixing roller 1. In the course of nipped conveying of the recording material P In the nip portion N, the unfixed toner image t is fixed by heat and pressure onto the recording material P.

In a state (I) in which the toner t is deposited on the recording material P, namely on an unfixed image, a fixing operation (A) is executed with the fixing roller 1 having a thermoplastic surface releasing layer 14 and the pressure roller 2 (with a fixing temperature lower than the melting point of the surface releasing layer 14), whereby the toner t is fixed onto the recording material (II). The recording material P with the thus formed image is discharged from the nip portion N by the fixing roller 1 and the pressure roller 2 (III). In an ordinary image formation, this fixing operation (I) is repeated.

During such fixing operation, the surface profile improving member 3 is preferably spaced from the fixing roller 1 in consideration of heat efficiency and prevention of damage or smear, but such spacing is not essential. This is because, as the surface temperature of the fixing roller 1 at the fixing operation is in a temperature area lower than the melting point of the surfaced releasing layer 14, the surface of the fixing roller 1 is not influenced by the surface profile improving member 3 in the fixing operation (1).

b) Surface Profile Forming Operation (2)

FIG. 48 shows a surface profile forming operation (surface condition changing operation) (2), which is executed by the control portion 5 according to a surface profile forming operation program (surface profile forming operation mode or surface condition changing mode) stored in a memory of the control portion 5. The surface profile forming operation is executed for example when the user operates a surface profile forming operation switch on a display panel provided on the image forming apparatus A In case the surface of the fixing roller 1 is roughed to detrimentally influence the image, or when a number of image formations at which the surface of the fixing roller 1 is estimated to be roughed to detrimentally influence the image is reached, or after a jam processing.

At first the support member of the pressure roller 2 is rotated in a spacing direction to space the pressure roller 2 from the fixing roller 1, and the solenoid 4 is turned on to contact the surface profile improving member 3 with the fixing roller 1 (III).

In such contact state, the fixing roller 1 is rotated in the direction of the arrow (clockwise) by the driving system M to rotate the surface profile improving member 3 in the direction of the arrow (counterclockwise), then the fixing roller 1 is gradually heated to a temperature area equal to or higher than the melting point of the surface releasing layer 14, and the heater driving circuit 8 is on/off controlled according to the roller surface temperature detected by the (non-contact) temperature detector 7 to control the power supply to the heater 12 and to achieve a temperature control to a predetermined temperature (second set temperature), thereby executing a surface profile forming (surface condition change) (V). Thus, since the surface releasing layer 14 is heated to a temperature area of the melting point or higher and the surface profile improving member 3 is driven by the rotation of the fixing roller 1, the surface condition of the surface profile improving member 3 is transferred onto the surface of the fixing roller 1 thereby improving the surface of the fixing roller 1, namely the surface profile of the surface releasing layer 14. The second set temperature is equal to or higher than the melting point of the releasing layer 14 of the fixing roller 1. In order to improve the surface releasing layer 14, for example a revolution, a driving time of the fixing roller 1 are suitably selected corresponding to the temperature area equal to or higher than the melting point of the surface releasing layer 14. Also the surface profile improving member 3 may be contacted with the surface of the fixing roller 1 after the surface of the fixing roller 1 is heated to a temperature equal to or higher than the melting point of the releasing layer 14.

As explained above, the control means 5 is capable of setting a first set temperature which is higher than the melting point of the toner but lower than the melting point of the surface layer of the fixing rotary member 1 and a second set temperature equal to or higher than the melting point of the surface layer 14 of the fixing rotary member 1. Also, when the surface condition changing mode is set, the heat generation of the heater 12 is so controlled that the surface temperature of the fixing rotary member 1 becomes equal to or higher than the melting point of the surface layer 14 of the fixing rotary member 1.

After the improvement of the surface profile, the heater driving circuit 8 is on/off controlled according to the roller surface temperature detected by the temperature detector 7 to control the power supply to the heater 12, thereby gradually lowering the surface temperature of the fixing roller 1 to the temperature area equal to or lower than the melting point of the surface releasing layer 14, thus executing a cooling. In this operation, in order to prevent an unevenness formation in the surface profile in the circumferential direction of the fixing roller 1, the surface profile improving member 3 is not spaced from the fixing roller 1 during the cooling operation. When the surface releasing layer 14 is cooled to a temperature area equal to or lower than the melting point thereof, the surface profile improving member 3 is spaced from the surface of the fixing roller 1 by turning off the solenoid 4 (VI). Thus the surface profile forming operation (2) is completed.

In the surface profile forming operation (2), when the cooling is completed, by the transfer of the surface condition of the surface profile improving member 3, the surface condition of the surface releasing layer 14 of the fixing roller 1 is restored to a satisfactory state. As the surface of the surface profile improving member 3 is mirror-finished, such mirror surface is transferred to the surface of the surface releasing layer 14.

Also after the completion of cooling, the pressure roller 2 is contacted again with the fixing roller 1. This is because the surface profile of the fixing roller 1 is influenced by the surface condition of the pressure roller 2 if the contact is made before the completion of the cooling.

In the surface profile forming operation (2), the surface profile improving member 3 may be spaced by gradually reducing the pressure thereof before the start of cooling. In such case, there is employed, instead of the solenoid 4, an arbitrary mechanism or apparatus capable of spacing surface profile improving member 3 by a pressure reduction from the fixing roller 1. Otherwise, it is also possible not to space the surface profile improving member 3 as explained before.

5) Evaluation

In the following there will be shown an example on a detailed temperature relationship between the fixing temperature of the toner and the melting point of the surface releasing layer 14 of the fixing roller 1, in order to verify the fixing ability (fixing property, separability of recording material and image quality after fixation) in case the type of the releasing layer 14 is changed.

There will be explained examples of employing five different thermoplastic layers as the surface releasing layer 14 of the foregoing example.

For the surface releasing layer 14, there were employed, among the thermoplastic fluorinated resins Dyneon™THV manufactured by Sumitomo-3M Co., grades THV220, THV415, THV500, THV610 and THV815. The releasing layer 14 may be provided, on the metal core 11 or the elastic layer 13 of the fixing roller 1, as a tube or by coating. As a toner to be fixed, there was employed a toner of wax inclusion type that can be fixed satisfactorily at 155–175° C., and the fixation was conducted at 165° C. in order to obtain a relationship between the type of the surface releasing layer 14 (different in melting point) and 10 the fixing temperature.

Table 1 shows the melting point of the fluorinated resins in the abscissa, and the thickness of the surface releasing layer 14 in the ordinate, and indicates the image property (image quality) and is the fixing property when the type and the thickness of the fluorinated resin are changed.

TABLE 1

| | | Resin name | | | | |
|---|---|---|---|---|---|---|
| | | THV220 | THV415 | THV500 | THV610 | THV815 |
| melting point ° C. | | 110–130 | 150–160 | 160–175 | 180–195 | 220–230 |
| thickness | image property | wrapping | image property | C | AA | A |
| 50 μm | fixing property | generated | fixing property | B | AA | A |
| thickness | image property | image property | C | C | AA | B |
| 200 μm | fixing property | fixing property | C | B | AA | B |

AA: excellent
A: good
B: fair
C: poor

As will be apparent from Table 1, satisfactory results can be obtained only when the fluorinated resin has a melting point higher than the fixing temperature of 165° C. (THV610 and THV815).

Also a significant difference from the prior fluorinated resins is that, at a thickness as large as 200 μm, satisfactory results can be obtained when the melting point of the fluorinated resin is closer to the fixing temperature (165° C.). This is because the surface releasing layer 14 has a restituting elasticity as an appropriate elastomer, as the difference between the melting point of the fluorinated resin and the fixing temperature is very small, such as about 20° C. in the case of THV610. Thus, in contrast to the prior technology in which the durability and the imaging property are in a trade-off relationship with respect to the thickness, a control that does not sacrifice the imaging property even at a large thickness is also an effect of the present invention and a high durability can thus be realized.

The above-described evaluation was conducted with a toner showing satisfactory fixing property at a fixing temperature of 165° C. Three fluorinated resins THV220, THV415 and THV500, having melting points close to or lower than 165° C., showed certain drawbacks as shown in Table 1, but these three fluorinated resins may provide satisfactory fixing ability by employing a toner having a fixing temperature lower than that of the toner employed in this evaluation. Thus, it will be understood that the fixing ability and the satisfactory protection of the components of the fixing apparatus 112 can be satisfied in case the releasing layer 14 has a melting 10 point higher than the melting point of the toner to be employed in the image forming apparatus and equal to or lower than 250° C.

Also as will be understood from the foregoing description, the control means is capable of setting at least a first set temperature which is higher than the melting point of the toner but lower than the melting point of the surface layer 14 of the fixing rotary member 1 and a second set temperature equal to or higher than the melting point of the surface layer 14 of the fixing rotary member 1.

Such conditions required for the releasing layer 14 of the fixing roller 1 (fixing rotary member 1) and the functions of the control means 5 are also the same in the following embodiments.

Embodiment 2J

Figure 5:
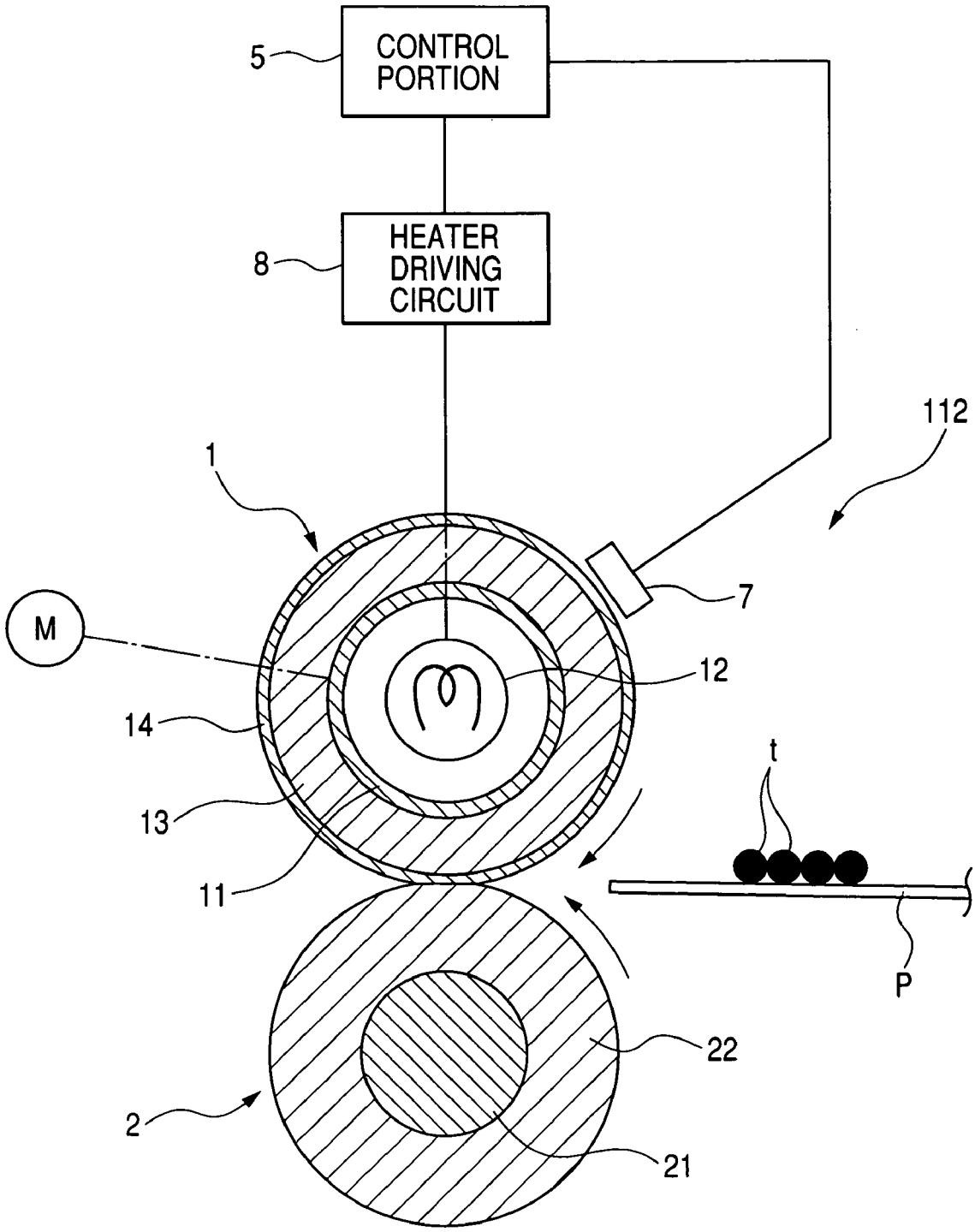
FIG. 5 is a schematic view showing a configuration of a fixing apparatus of embodiment 2.

The fixing apparatus 112 of embodiment 1 is provided with the surface profile improving member 3 for executing the surface profile formation of the fixing roller 1, but the surface profile improving member 3 is not essential and the fixing apparatus 112 may be constructed, as shown in FIG. 5, by utilizing the pressure roller 2 as a surface profile improving member. In such case, the surface of the pressure roller 2, as in the surface profile improving member 3, has naturally to be given in advance a surface condition required for the surface condition of the fixing roller 1, such as a mirror-finish obtained by modifying the surface of the elastic layer 22. Also in the pressure roller 2, a surface layer (not shown) having a sufficient strength such as of a metal, a polyimide resin or a fluorinated resin of a sufficient thickness is preferably laminated on the elastic layer 22.

For executing the surface profile forming operation for the fixing roller 1, while the fixing roller 1 and the pressure roller 2 are in contact, the fixing roller 1 is rotated in the direction of the arrow (clockwise) by the driving system M to rotate the pressure roller 2 in the direction of arrow (counterclockwise), then the fixing roller 1 is gradually heated to a temperature area equal to or higher than the melting point of the surface releasing layer 14, and the heater driving circuit 8 is on/off controlled according to the roller surface temperature detected by the (non-contact) temperature detector 7 to control the power supply to the heater 12 and to achieve a temperature control at a constant temperature (second set temperature), thereby executing a surface profile forming (surface condition change). Thus, since the surface releasing layer 14 is heated to a temperature area of the melting point or higher and the pressure roller 2 is driven by the rotation of the fixing roller 1 in such state, the surface of the fixing roller 1, namely the surface profile of the surface releasing layer 14, can be improved.

After the improvement of the surface profile, the heater driving circuit 8 is on/off controlled according to the roller surface temperature detected by the temperature detector 7 to control the power supply to the heater 12, thereby gradually lowering the surface temperature of the fixing roller 1 to the temperature area equal to or lower than the melting point of the surface releasing layer 14, thus executing a cooling. The surface profile forming operation is completed by cooling to a temperature area equal to or lower than the melting point of the surface releasing layer 14.

Embodiment 3

Figure 6:
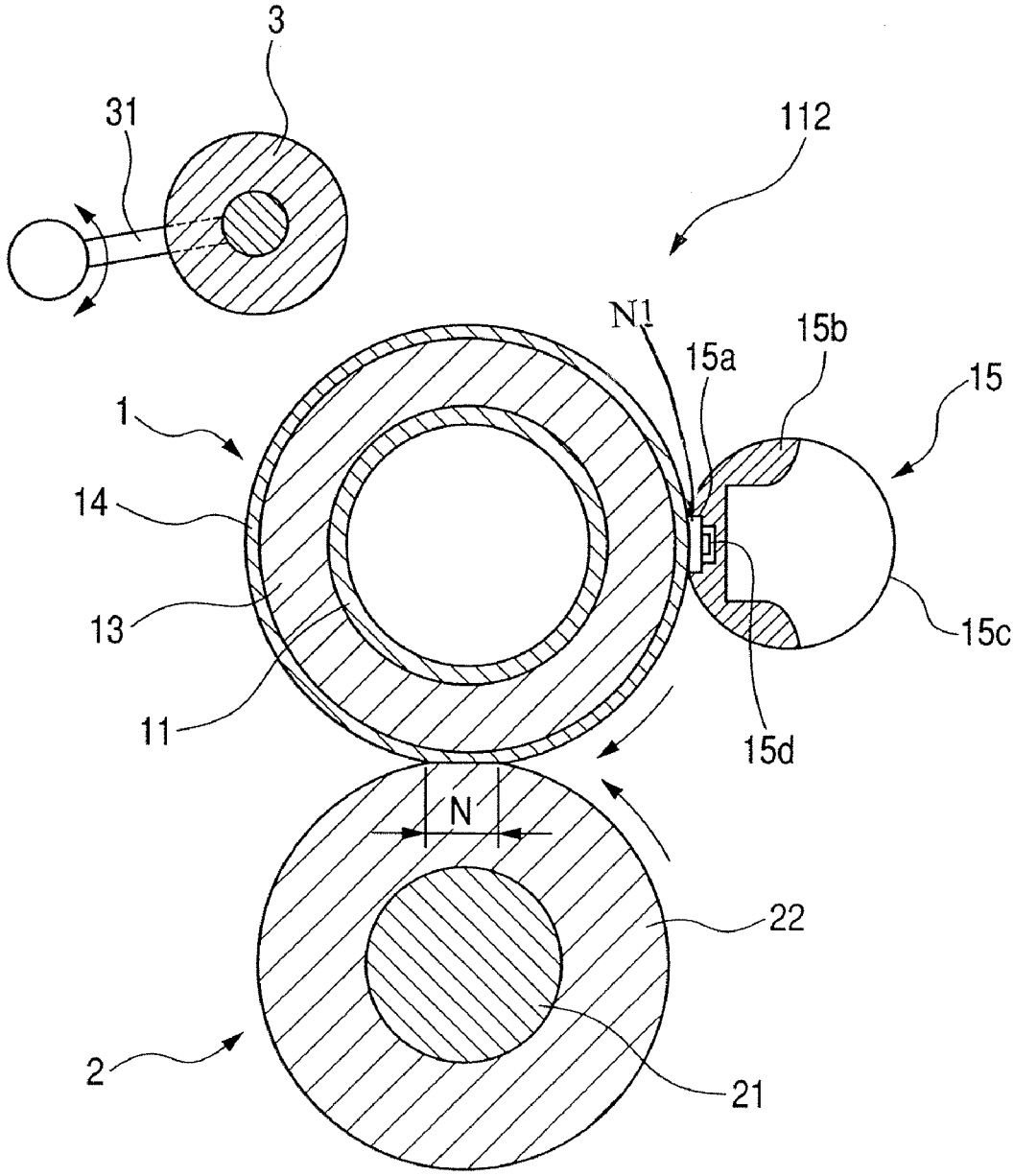
FIG. 6 is a schematic view showing a configuration of a fixing apparatus of embodiment 3.

The fixing apparatus 112 of embodiment 1 has a heater 12 inside the fixing roller 1, but such heater 12 may be replaced by a heat source provided outside the fixing roller 1. FIG. 6 is a schematic view showing a configuration of a fixing apparatus 112 of embodiment 3. The present embodiment 3 employs, as a heat source, a ceramic heater unit 15 of a known film heating type. The heater unit 15 includes a ceramic heater 15*a* as a heating member, a stay 15*b* constituting a support member for supporting the heater 15*a* under heat insulation, and a thin cylindrical film 15*c* of a heat-resistant resinous material, provided rotatably about the stay 15*b* supporting the heater 15*a*. The heater unit 15 is so positioned that a side of the heater 15*a* is parallel to the fixing roller 1, and is pressed to the fixing roller 1 under a predetermined pressure. In such state, the fixing roller 1 and the heater 15*a* form a nip portion NI across the film 15*c*. When the fixing roller 1 is driven in rotation, the film 15*c* of the heater unit 15 is driven in rotation, in sliding contact with the heater 15*a* and the stay 15*b*. Then the heater 15*a* is energized to generate heat, thereby heating the surface of the fixing roller 1. On a rear surface of the heater 15*a*, a temperature detector (temperature detection means) 15*d* is provided, and, based on a heater temperature detected by such temperature detector 15*d*, an unillustrated control portion executes an on/off control on a heater driving circuit to control the power supply to the heater 15*a*, thereby controlling the roller surface temperature to a fixing temperature suitable for the aforementioned fixing operation, or to a temperature area matching the aforementioned surface profile forming operation. The surface profile forming operation for the fixing roller 1 is similar to that in the fixing apparatus 112 of embodiment 1 and will not be explained in repetition.

The fixing apparatus of the present embodiment employs a ceramic heater unit 15 of film heating type, but there may be employed instead a halogen heater unit equipped with a halogen heater inside a metal roller driven in rotation by the rotation of the fixing roller 1.

In the fixing apparatus of external heating type having a heat source outside the fixing roller 1 as In the present embodiment, the ceramic heater unit 15 or the halogen heater unit itself may be utilized as a surface profile improving member.

Embodiment 4

Figure 7:
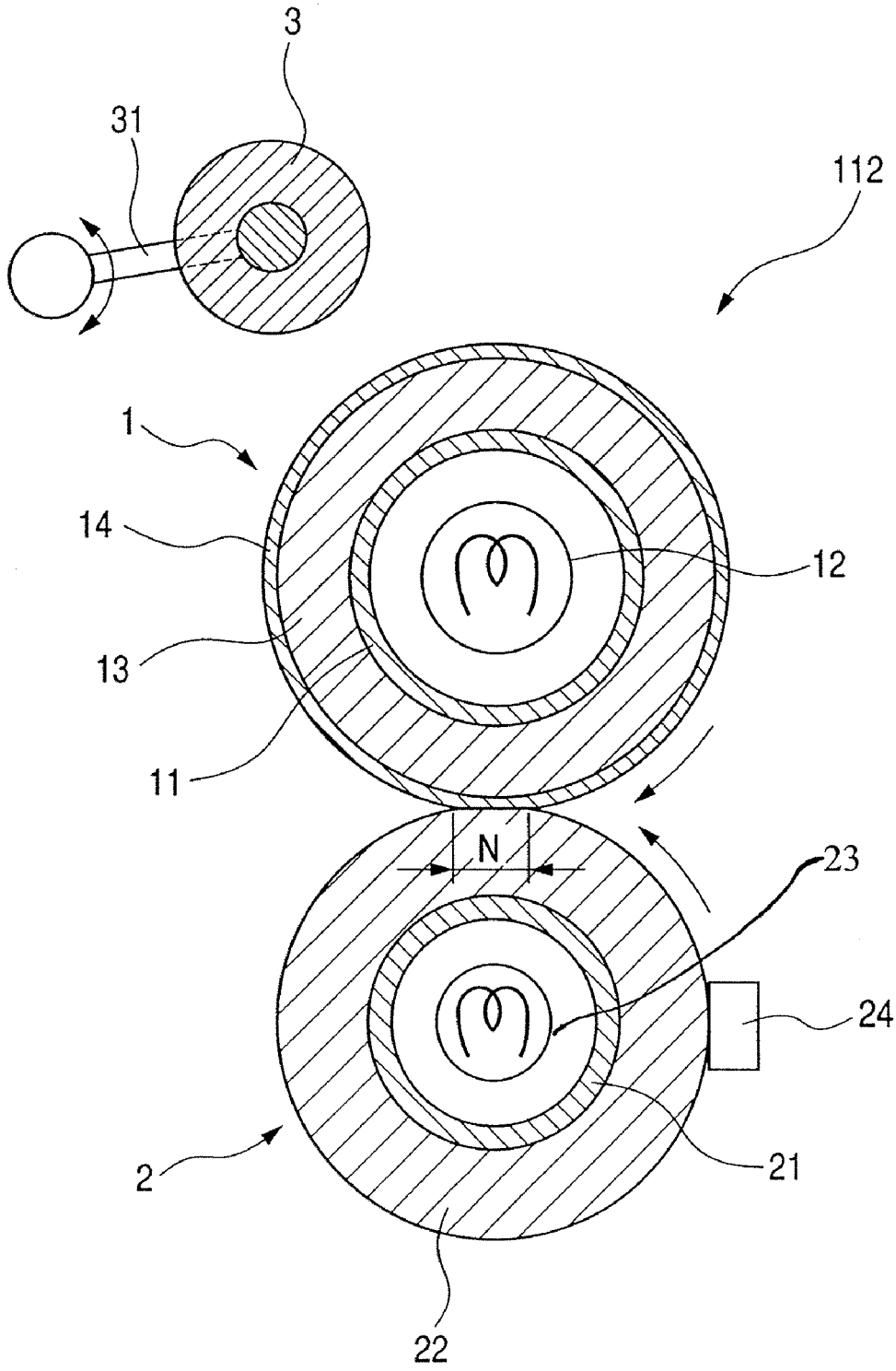
FIG. 7 is a schematic view showing a configuration of a fixing apparatus of embodiment 4.

The fixing apparatus 112 of embodiment 1 has a heater 12 inside the fixing roller 1, but a heat source may also be provided in the pressure roller 2. FIG. 7 is a schematic view showing a configuration of a fixing apparatus of embodiment 4. In the present embodiment 4, the fixing apparatus 112 is provided with a heater 23 such as a halogen heater, as a heat source, inside the cylindrical metal core 21. In the fixing apparatus 112 of the present embodiment, the heater 23 generates heat by a power supply from an unillustrated heater driving circuit, thereby heating the surface of the pressure roller 2. On a periphery of the pressure roller 2, a temperature detector (temperature detecting means) 24 is contacted, and, based on the roller surface temperature detected by the temperature detector 24, an unillustrated control portion executes an on/off control of the heater driving circuit to control the power supply to the heater 12 and the heater 23, thereby controlling the surface temperature of the pressure roller 2 at the target temperature. In the present embodiment, the surface temperature of the fixing roller 1 is estimated by monitoring the surface temperature of the pressure roller 2. Also in the fixing apparatus 112 of the present embodiment, the surface profile forming operation for the fixing roller 1 is similar to that in the fixing apparatus 112 of embodiment 1 and will not be explained in repetition.

Embodiment 5

Figure 8:
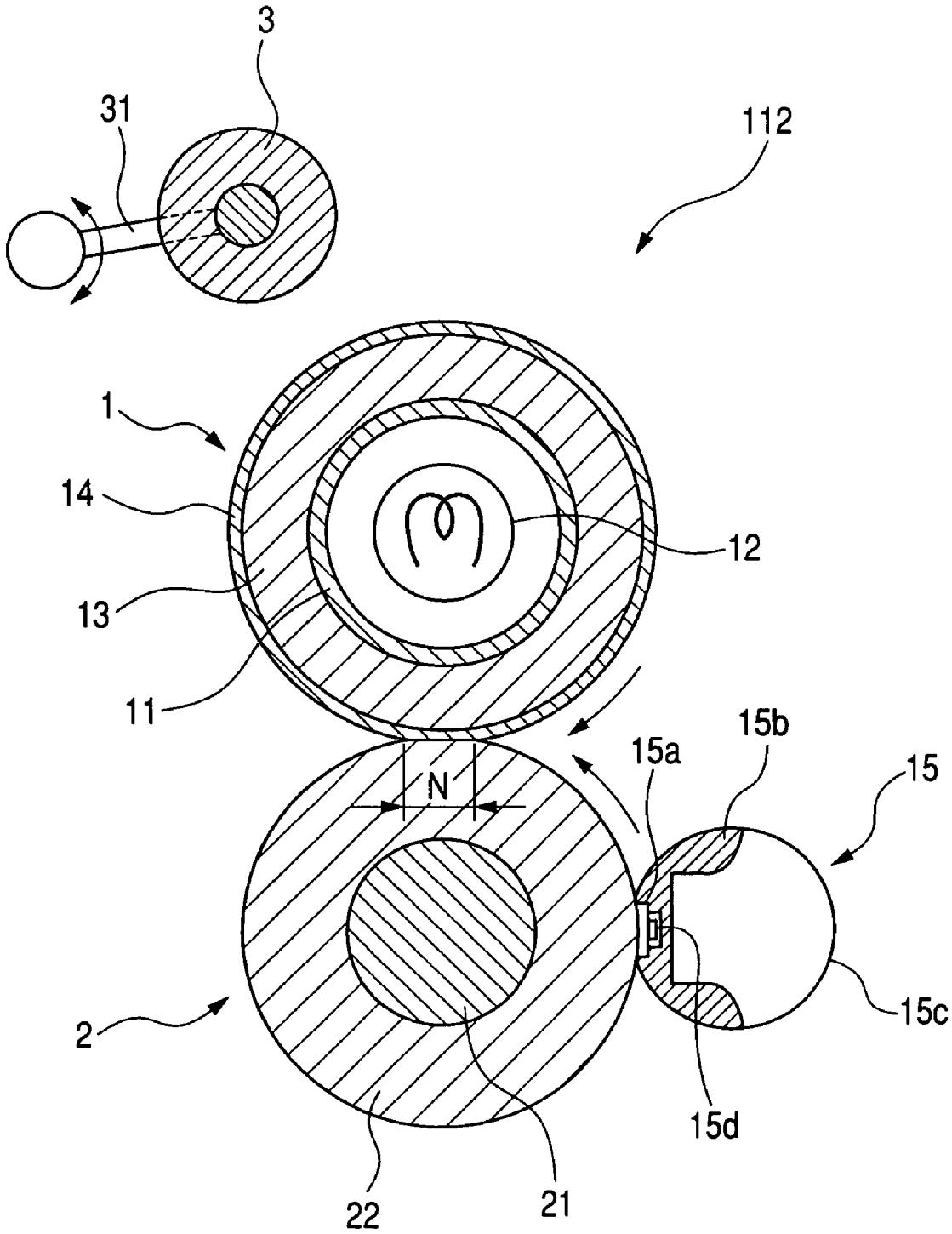
FIG. 8 is a schematic view showing a configuration of a fixing apparatus of embodiment 5.

The fixing apparatus 112 of embodiment 4 has a heater 23 inside the pressure roller 2, but such heater 23 may be replaced by a heat source provided outside the pressure roller 2. FIG. 8 is a schematic view showing a configuration of a fixing apparatus 112 of embodiment 5. The present embodiment 5 employs, as a heat source, a ceramic heater unit 15 of a known film heating type employed in embodiment 3. Also in the fixing apparatus 112 of the present embodiment, the surface profile forming operation for the fixing roller 1 is similar to that in the fixing apparatus 112 of embodiment 1 and will not be explained in repetition.

The fixing apparatus of the present embodiment employs a ceramic heater unit 15 of film heating type, but there may be employed instead a halogen heater described above.

Embodiment 6

Figure 9:
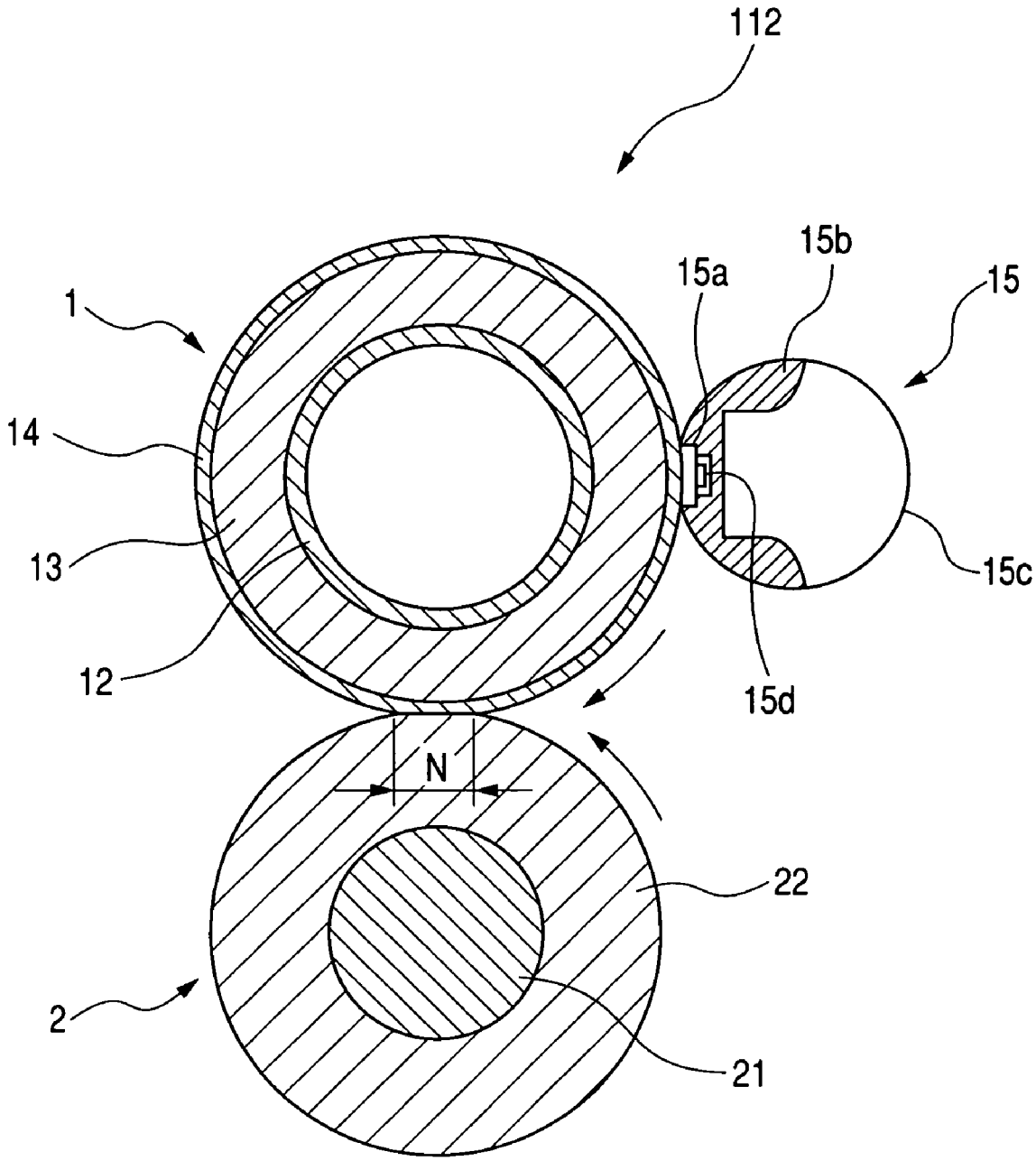
FIG. 9 is a schematic view showing a configuration of a fixing apparatus of embodiment 6.

The fixing apparatus 112 of embodiment 2, utilizing the pressure roller 2 as a surface profile improving member, has a heater 12 inside the fixing roller 1, but such heater may be provided outside the fixing roller 1. FIG. 9 is a schematic view showing a configuration of a fixing apparatus 112 of embodiment 6. The present embodiment employs, as a heat source, a ceramic heater unit 15 of film heating type employed in the embodiment 3. Also in present embodiment, the surface profile forming operation for the fixing roller 1 is similar to that in the fixing apparatus 112 of embodiment 2 and will not be explained in repetition.

The fixing apparatus 112 of the present embodiment employs a ceramic heater unit 15 of film heating type, but there may be employed instead a halogen heater unit described above.

In the fixing apparatus of 112 external heating type having a heat source outside the fixing roller 1 as In the present embodiment, the ceramic heater unit 15 or the halogen heater unit itself may be utilized as a surface profile improving member.

Embodiment 7

The foregoing embodiments 1–6 are to restore the surface of the fixing rotary member 1. In contrast, the following embodiments are to change a surface condition of the entire surface releasing layer 14, or a part thereof, of the fixing rotary member 1 thereby controlling a gloss of an entire surface of the recording material (including a toner-free area thereon) or a part thereof, or of a toner image portion (toner layer only). A structure of the fixing apparatus of the present embodiment is the same as that of embodiment 1 except that two surface condition changing members are provided, and will not, therefore, be explained in repetition. A releasing layer of the fixing roller 1 (fixing rotary member) is, as in embodiment 1, constituted of a thermoplastic resin Dyneon™THV manufactured by Sumitomo-3M Co.

Figure 10:
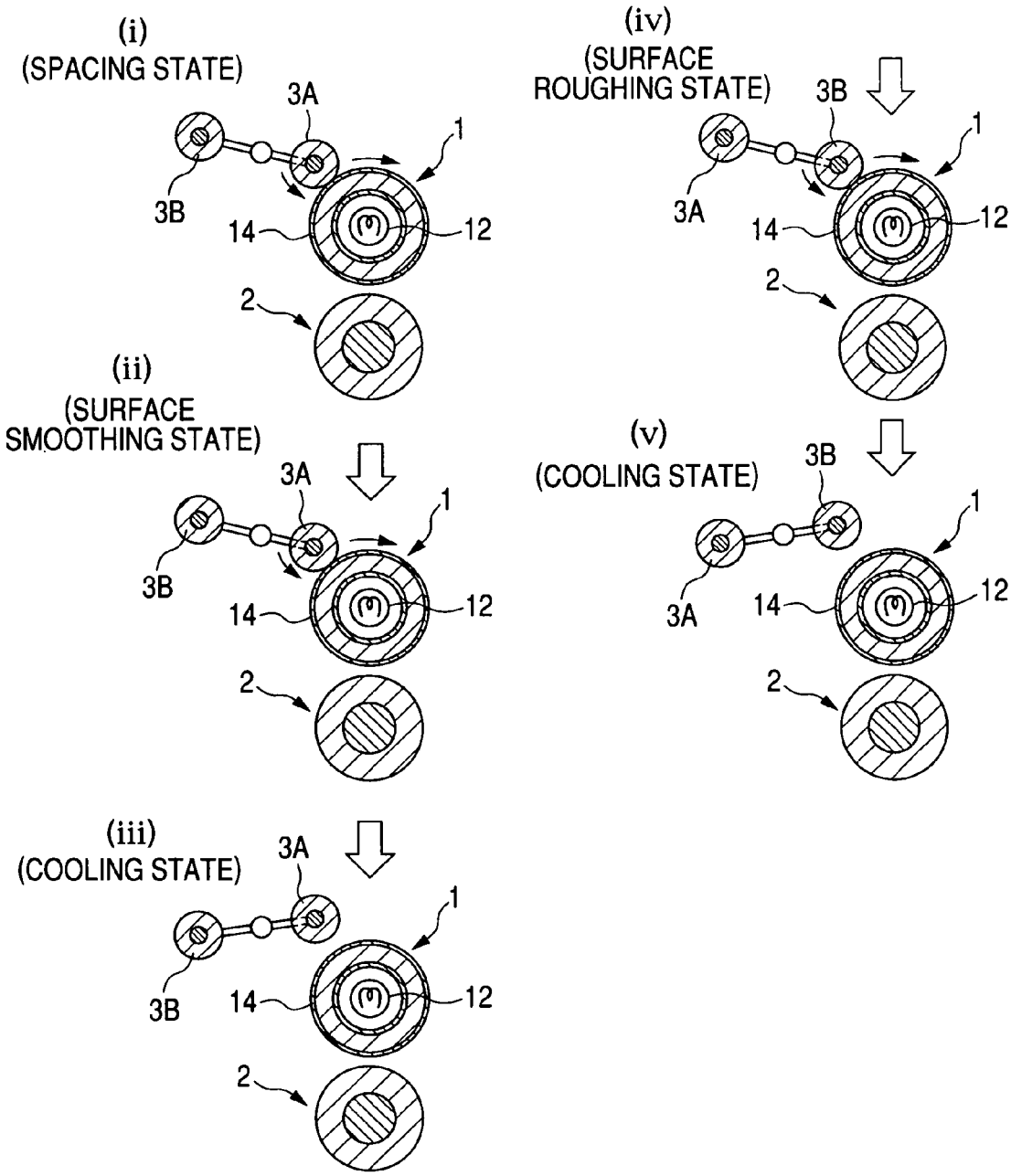
FIG. 10 is a view showing a surface condition changing operation in an fixing apparatus of embodiment 7.

FIG. 10 illustrates a gloss control operation (surface condition changing operation) to be explained later. This operation is executed when a surface condition changing mode is set.

Symbols 3A and 3B both indicate surface condition changing members, of which a smoothing member 3A has a mirror-finished surface while a roughing member 3B has a surface subjected to a blast work. The roughing member has a surface rougher than that of the smoothing member. The surface condition changing members 3A, 3B are both rollers having a length approximately equal to that of the fixing roller 1.

The fixing apparatus of the present embodiment can be switched to a state In which the releasing layer 14 of the fixing roller 1 is smoothed (first state) and a state in which the releasing layer 14 of the fixing roller 1 is roughed (second state), and can execute a fixing operation in each state.

The surface releasing layer 14 of the fixing roller 1 is constituted, as in embodiment 1, of a thermoplastic material having a melting point of 250° C. or lower, particularly lower than the melting point of PFA or the like conventionally employed in the releasing layer 14. Also the fixing apparatus of the present embodiment can execute (A) a surface condition changing operation in a temperature area in which the surface condition of the surface releasing layer 14 is changeable, and (B) a fixing operation in a temperature area in which the surface condition of the surface releasing layer 14 is scarcely changeable. Thus, as in embodiment 1, the control means can set a first set temperature higher than the melting point of the toner and lower than the melting point of the surface layer 14 of the fixing rotary member 1, and a second set temperature equal to or higher than the melting point of the surface layer 14 of the fixing rotary member 1. When a surface condition changing mode is set, it controls the heat generation of the heater 12 in such a manner that the surface temperature 15 of the fixing rotary member 1 becomes equal to or higher than the melting point of the surface layer 14 of the fixing rotary member 1.

In a temperature area equal to or higher than the melting point of the surface releasing layer 14, the surface condition of the surface releasing layer 14 is in a state influenced by a member coming into contact with the releasing layer 14. In such state, by contacting the smoothing member 3A with the releasing layer 14, it can be brought to a surface condition close to that of the smoothing member 3A, and, by contacting the roughing member 38 with the releasing layer 14, it can be brought to a surface condition close to that of the roughing member 3B. In case of roughing the surface of the releasing layer 14 with the roughing member 3B, it is preferable, before contacting the roughing member 3B, to contacting the smoothing member 3A having a mirror-finished surface with the releasing layer 14 thereby bringing the releasing layer 14 to an initial mirror-finished state. Such initialization of the surface condition of the releasing layer 14 prior to the contact of the roughing member 3B provides an advantage that the surface of the releasing layer 14 can be adjusted to a desired rough surface after the contact of the roughing member 3B.

As in embodiment 1, the surface releasing layer 14 is formed by a material having a melting point higher than a good toner fixing area between a cold offset area and a hot offset area for the toner to be used in the image forming apparatus, and equal to or lower than 250° C. A temperature area equal to 20 or higher than the melting point of the releasing layer 14 constitutes a surface condition changeable area, In which the surface condition changing operation (A) is executed. Also a temperature area lower than the melting point of the releasing layer 25 14 constitutes a surface condition unchangeable area, In which a fixing operation (B) is executed.

The present embodiment, being capable of transferring the surface condition of the smoothing member 3A or the roughing member 3B onto the surface of the fixing roller 1 by the aforementioned surface condition changing operation (A), it is possible, at 5 the fixing operation (B), to transfer the mirror finish surface of the fixing roller 1 onto the entire area of the recording material (including an area without the toner layer thereon) or a part thereof, or onto a toner image portion (toner layer part only), or to transfer the rough surface. In this manner it is possible to control the gloss of the entire area of the recording material (including an area without the toner layer thereon) or a part thereof, or onto a toner image portion (toner layer part only) Since the gloss is not controlled by a toner fusion state as in the prior technology but a surface condition of the toner layer is controlled by the surface condition of the fixing roller 1, it is rendered possible to obtain a natural light reflection and to achieve stable and uniform gloss control. In case of transferring the surface condition of the fixing roller 1 onto the entire surface of the recording material (including an area without the toner layer), the fixing apparatus of the present embodiment has to be mounted on an image forming apparatus capable of utilizing a recording material having a resin layer on a paper surface or forming a transparent toner layer on the recording material.

Also, in order to facilitate the transfer of the surface condition of the surface condition changing members 3A and 38, particularly that of the roughing member 38, the releasing layer preferably has a thickness of 100–500 μm. With a thickness less than 100 μm, the rough surface of the roughing member 38 becomes difficult to be transferred faithfully onto the releasing layer 14 of the fixing roller 1. Also the releasing layer 14 employed in the present embodiment has an appropriate elasticity even in a temperature area lower than the melting point of the releasing layer 14, a sufficient fixing ability can be exhibited even with a thickness selected within a range of 100–500 μm. In the present embodiment, the releasing layer 14 has a thickness selected at 200 μm. The releasing layer 14 may be provided on the metal core of the fixing roller 1 as a tubular member or by coating thereon, but, In the present embodiment, is preferably provided by a tubular member as the releasing layer 14 having a thickness of 100 to 500 μm.

The toner layer on the recording material is not yet fused immediately after the entry into the fixing nip portion and therefore has a irregular surface, but the releasing layer 14 employed in the present embodiment, having an appropriate elasticity even In a temperature area lower than the melting point of the releasing layer 14, closely contacts (with an elastic deformation of the releasing layer 14) the entire surface of the toner layer immediately after the entry into the fixing nip portion thereby achieving a uniform heating from the entire surface of the toner layer. Also in a downstream side in the fixing nip portion, in the proceeding direction of the recording material, the toner is fused and becomes softer than the releasing layer 14. In this state, by the elastic force of the releasing layer 14 itself, the surface of the releasing layer 14 returns to an original surface condition (surface condition formed by the surface condition changing members 3A, 3B). By separating the releasing layer 14 and the recording material (toner image) in this state, the surface condition of the toner layer becomes the same as the surface condition of the releasing layer 14.

Thus, the releasing layer 14 employed in the present embodiment, having an appropriate elasticity even in a temperature area lower than the melting pint of the releasing layer 14, provides an advantage that a gloss of the toner image can be adjusted according to the surface condition of the releasing layer 14.

a) Surface Condition Changing Operation (a)

In the following, a surface condition changing operation (A) of the releasing layer 14 will be explained with reference to FIG. 10. As explained in the foregoing, the structure of the fixing apparatus of the present embodiment is the same as that of embodiment 1 shown in FIG. 2 except that two surface condition changing members 3A, 3B are provided, and, though not illustrated in FIG. 10, the surface temperature of the fixing roller 1 is detected by a temperature detector 7 not in contact therewith and a control portion 5 controls functions of the surface condition changing members 3A, 3B and on/off states of the heater 12.

The surface condition changing operation (A) is executed, as in embodiment 1, by the control portion 5 according to a surface condition changing operation program (surface condition changing mode) stored in a memory of the control portion 5. The surface condition changing operation of the present embodiment is executed at a timing when the user operates a surface condition changing switch on a display panel provided in the image forming apparatus. However such timing of execution is not limited to that in the present embodiment but may be selected suitably.

Now there will be explained, with reference to FIG. 10, a case of changing the surface of the fixing roller 1 to a surface condition of the roughing member 3B.

At first the support member of the pressure roller 2 is rotated in a spacing direction to space the pressure roller 2 from the fixing roller 1, and the solenoid 4 is turned on to contact the smoothing member 3A with the fixing roller 1 (step i).

In such contact state, the fixing roller 1 is rotated in the direction of the arrow (clockwise) by the driving system M, to drive the smoothing member 3A in the direction of the arrow (counterclockwise), then the fixing roller 1 is gradually heated to a temperature area equal to or higher than the melting point of the surface releasing layer 14, and the heater driving circuit 8 is on/off controlled according to the roller surface temperature detected by the (non-contact) temperature detector 7 to control the power supply to the heater 12 and to achieve a temperature control at a constant temperature (second set temperature), thereby executing a surface smoothing step (step ii). Thus, since the surface releasing layer 14 is heated to a temperature area of the melting point or higher and the smoothing member 3A is driven by the rotation of the fixing roller 1 in such state, the surface condition of the smoothing member 3A is transferred onto the surface of the fixing roller 1, thereby changing the surface or namely the surface releasing layer 14 of the fixing roller 1. The second set temperature is equal to or higher than the melting point of the releasing layer 14 of the fixing roller 1. In order to change the surface releasing layer 14, a revolution and a driving time of the fixing roller 1 are suitably selected corresponding to the temperature area equal to or higher than the melting point of the surface releasing layer 14. Also the smoothing member 3A may be contacted with the surface of the fixing roller 1 after the surface of the fixing roller 1 is heated to a temperature equal to or higher than the melting point of the releasing layer 14.

After the surface condition of the fixing roller 1 is changed, the heater driving circuit 8 is on/off controlled according to the roller surface temperature detected by the temperature detector 7 to control the power supply to the heater 12, thereby gradually lowering the surface temperature of the fixing roller 1 to the temperature area lower than the melting point of the surface releasing layer 14, thus executing a cooling. In this operation, in order to prevent an unevenness formation in the surface condition in the circumferential direction of the fixing roller 1, the smoothing member 3A is not spaced from the fixing roller 1 during the cooling operation. When the surface releasing layer 14 is cooled to a temperature area lower than the melting point thereof, the smoothing member 3A is spaced from the surface of the fixing roller 1 by turning off the solenoid 4 (step iii).

The process is terminated at step iii in case the releasing layer 14 is changed from a surface condition corresponding to the roughing member 3B to a surface condition corresponding to the smoothing member 3A, or in case of restoring the releasing layer 14 as in embodiment 1.

Then the roughing member 3B instead of the smoothing member 3A is contacted with the fixing roller 1. In such contact state, the fixing roller 1 is rotated in the direction of the arrow (clockwise) by the driving system M to drive the roughing member 3B in the direction of the arrow (counterclockwise), then the fixing roller is gradually heated to a temperature area equal to or higher than the melting point of the surface releasing layer 14, and the heater driving circuit 8 is on/off controlled according to the roller surface temperature detected by the (non-contact) temperature detector 7 to control the power supply to the heater 12 and to achieve a temperature control at a constant temperature (second set temperature), thereby executing a surface roughing step (step iv). Thus, since the surface releasing layer 14 is heated to a temperature area of the melting point or higher and the roughing member 3B is driven by the rotation of the fixing roller 1 In such state, the surface condition of the roughing member 3B is transferred onto the surface of the fixing roller 1, thereby changing the surface or namely the surface releasing layer 14 of the fixing roller 1. In order to change the surface releasing layer 14, a revolution and a driving time of the fixing roller 1 are suitably selected corresponding to the temperature area equal to or higher than the melting point of the surface releasing layer 14. Also the roughing member 3B may be contacted with the surface of the fixing roller 1 after the surface of the fixing roller 1 is heated to a temperature equal to or higher than the melting point of the releasing layer 14.

In step iv, the contact pressure of the roughing member 3B may be suitably changed to vary a depth (recording depth) of the irregularities transferred onto the releasing layer 14 of the fixing roller 1 with respect to the depth of the irregularities on the surface of the roughing member 3B. Thus, even with a single roughing member 3B, a control of the contact pressure of the roughing member 3B onto the fixing roller 1 allows to change a level of surface roughness (a rough state to an almost smooth state) of the surface releasing layer 14, thereby expanding the range of the gloss control on the toner image at the fixing operation. It is also possible to utilize plural roughing members 3B.

After the surface condition is changed, the heater driving circuit 8 is on/off controlled according to the roller surface temperature detected by the temperature detector 7 to control the power supply to the heater 12, thereby gradually lowering the surface temperature of the fixing roller 1 to the temperature area lower than the melting point of the surface releasing layer 14, thus executing a cooling. In this operation, in order to prevent an unevenness formation in the surface condition in the circumferential direction of the fixing roller 1, the roughing member 3B is not spaced from the fixing 15 roller 1 during the cooling operation. When the surface releasing layer 14 is cooled to a temperature area lower than the melting point thereof, the roughing member 3B is spaced from the surface of the fixing roller 1 by turning off the solenoid 4 (step v)

Thus the surface condition changing operation (A) is terminated.

In the above-explained surface condition changing operation (A), at a point where the cooling is completed (step iii or step v), the surface condition of the surface releasing layer 14 of the fixing roller 1 is changed to a desired surface condition by the transfer of the surface condition of the surface condition changing member 3A or 38. Thus, in case the process is terminated at step iii, the surface condition (for example mirror-finish) of the smoothing member 3A is transferred onto the surface of the surface releasing layer 14 of the fixing roller 1, and, in case the process is terminated at step v, the surface condition (for example blasted-finish) of the roughing member 38 is transferred onto the surface of the surface releasing layer 14 of the fixing roller 1.

The pressure roller 2 is contacted again with the fixing roller 1 after the completion of cooling. This is because the surface condition of the fixing roller 1 is influenced by the surface condition of the pressure roller 2 if the contact is made prior to the completion of the cooling.

In the aforementioned surface condition changing operation (A), the surface condition changing member 3A or 38 may be spaced by gradually reducing the pressure thereof before the start of cooling. In such case, there is employed, instead of the solenoid 4, an arbitrary mechanism or apparatus capable of spacing the surface condition changing member 3A or 38 by a pressure reduction from the fixing roller 1.

Furthermore, the smoothing member 3A is not necessarily essential and may be dispensed with suitably. For example, it is possible, as in embodiment 2, to construct the fixing apparatus by utilizing the pressure roller as the smoothing member 3A.

b) Fixing Operation (B)

Figure 11:
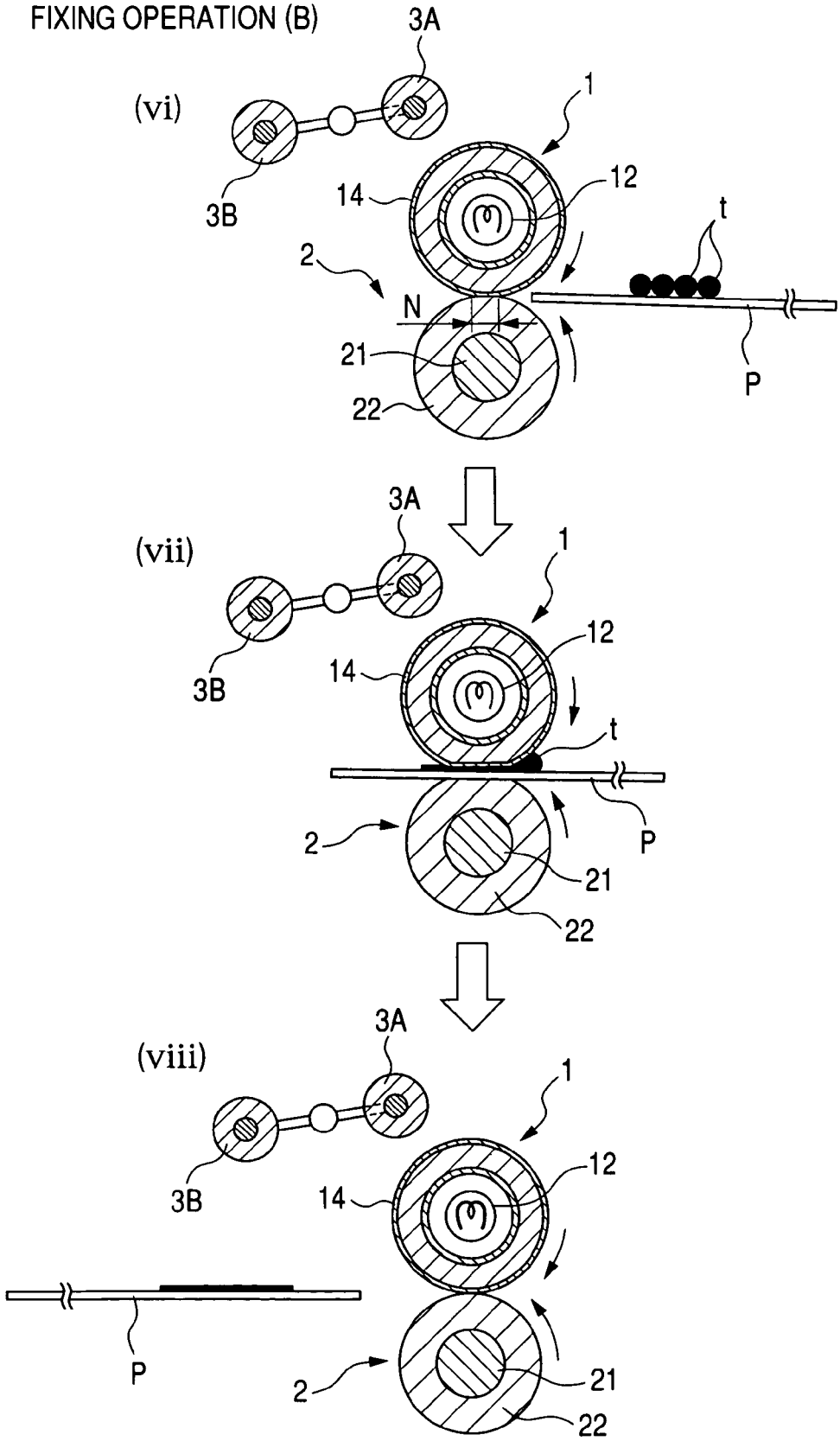
FIG. 11 is a view showing a fixing operation in the fixing apparatus of embodiment 7.

FIG. 11 shows a fixing operation (B), which is executed by the control portion 5 according to a fixing operation program (fixing operation mode) stored in the memory of the control portion 5.

In a state where the roller surface temperature of the fixing roller 1 reaches a temperature control target temperature (fixing temperature, first set temperature), a recording material P bearing an unfixed toner image t is introduced into the nip portion N (vi), then is nipped and conveyed in the nip portion N for fixing the toner image t by heat and pressure onto the recording material P (vii) and is then discharged (viii). The fixing temperature is higher than the melting point of the toner, but lower 20 than the melting point of the surface releasing layer 14. In such fixing operation (B), the surface condition of the fixing roller 1, formed by the aforementioned surface condition changing operation (A) is transferred onto the toner image, thereby providing an image of a desired gloss. In case of producing plural prints with a same gloss level, such fixing operation (B) is repeated.

During such fixing operation, the surface condition changing member 3A, 3B is preferably spaced from the fixing roller 1 in consideration of heat efficiency and prevention of damage or smear, but such spacing is not essential. This is because, as the surface temperature of the fixing roller 1 at the fixing operation is in a temperature area lower than the melting point of the surfaced releasing layer 14, the surface of the fixing roller 1 is not influenced by the surface condition changing members 3A, 3B at the fixing operation (B).

Embodiment 8

Figure 12:
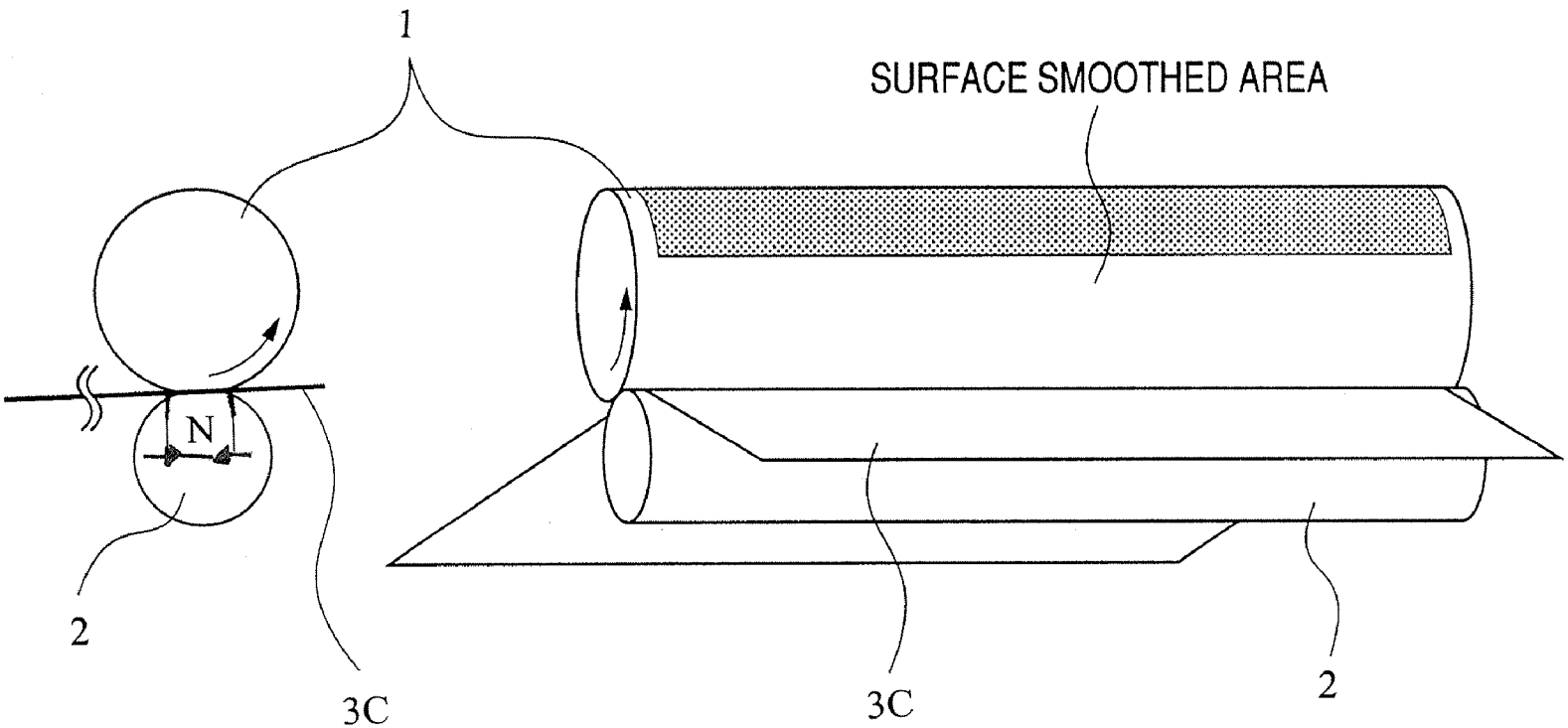
FIG. 12 is a view showing a surface condition changing operation of embodiment 8, providing a concept of a surface smoothing step with a smoothing sheet member.
Figure 13:
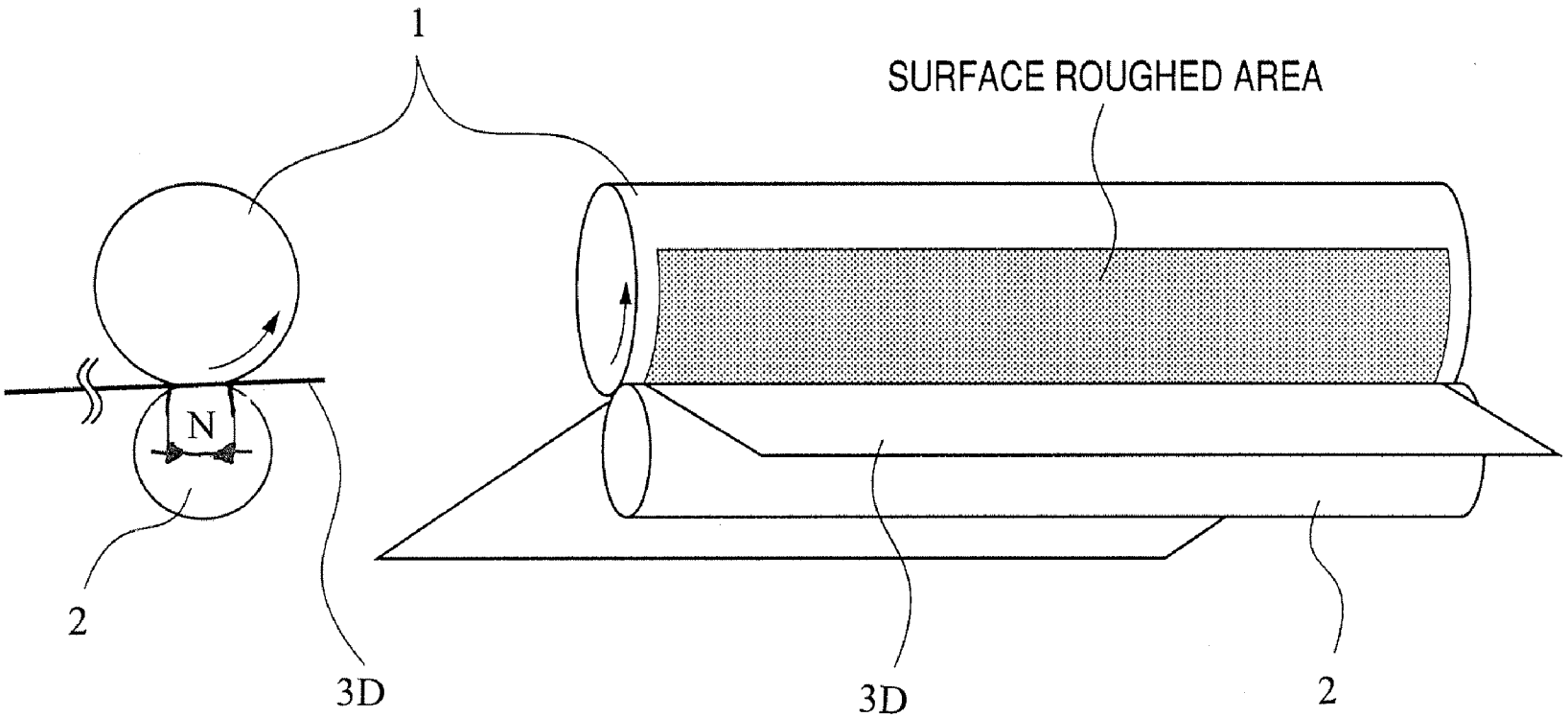
FIG. 13 is a view showing a surface condition changing operation of embodiment 8, providing a concept of a surface roughing step with a roughing sheet member.
Figure 14:
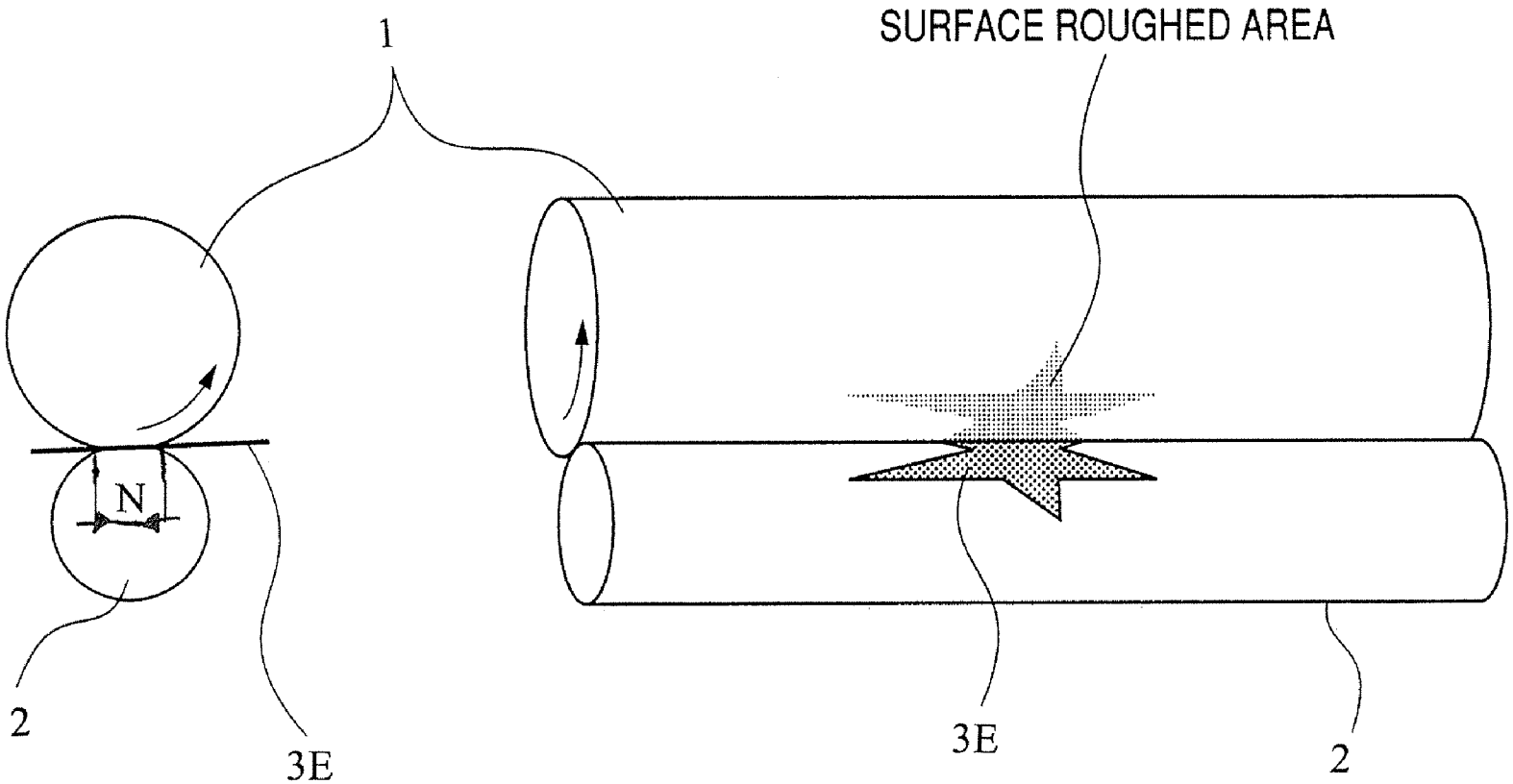
FIG. 14 is a view showing a surface condition changing operation of the embodiment 8, providing a concept of a surface roughing step with a roughing sheet member of a star shape.

Now an embodiment 8 will be explained with reference to FIGS. 12 to 14, which illustrate a concept of a surface condition changing operation by the fixing apparatus of the present embodiment.

The fixing apparatus of the present embodiment is not provided with the surface condition changing members 3A, 3B as in embodiment 7, and the surface condition of the fixing roller is changed by two sheets having surface conditions equivalent to those of the surface condition changing members 3A, 3B. A structure of the fixing apparatus of the present embodiment is the same as that of the fixing apparatus of embodiment 1, except that the surface condition changing members and the solenoid for contacting or spacing such members with or from the fixing roller are dispensed with, and will not, therefore, be explained further.

In the present embodiment, as in embodiment 1, the control means is capable of setting a first set temperature which is higher than the melting point of the toner but lower than the melting point of the surface layer of the fixing rotary member and a second set temperature equal to or higher than the melting point of the surface layer of the fixing rotary member. Also when a surface condition changing mode is selected, it controls the heat generation of the heater in such a manner that the surface temperature of the fixing rotary member becomes equal to or higher than the melting point of the surface layer of the fixing rotary member.

At first there are prepared a smoothing sheet member 3C having a surface condition equivalent to that of the smoothing member 3A of embodiment 7, and a roughing sheet member 3D having a surface, condition equivalent to that of the roughing member 3B of embodiment 7. The smoothing sheet member 3C and the roughing sheet member 3D have a length at least equal to a circumferential length of the fixing roller and a width at least equal to a width of an image formed In the image forming apparatus. The smoothing sheet member 3C is preferably a metal plate or a high-gloss paper having a mirror surface or a glossy surface. The roughing sheet 3D is preferably a metal plate or a heat-resistant resin sheet having a blast-worked surface condition. Such smoothing sheet 3C or the roughing sheet 3D is passed through the fixing nip portion N in a state where the surface of the fixing roller 1 is heated to the melting point or higher of the releasing layer and the fixing roller 1 and the pressure roller 2 are in a mutual contact, and can thus be used in place for the smoothing member 3A or the roughing member 3B in embodiment 7.

In the following, the surface condition changing operation of the present embodiment will be explained.

At first, a surface condition smoothing step of the present embodiment will be explained In detail. FIG. 12 shows a cross-sectional view and a perspective view of a fixing apparatus in the course of the surface condition smoothing step.

At first, in a state where the fixing roller 1 and the pressure roller 2 are mutually pressed, a leading end of the smoothing sheet member 3C is introduced into the fixing nip portion N. In this state, the fixing roller 1 is rotated by the driving system M in the direction of the arrow (clockwise), and, while the smoothing sheet member 3C is passed, the surface of the fixing roller 1 is gradually heated to a second set temperature equal to or higher than the melting point of the surface releasing layer 14 and the heater 12 is so controlled as to maintain this temperature. Thus, by heating the surface releasing layer 14 to a temperature area equal to or higher than the melting point, and by nipping and conveying the smoothing sheet member 3C in the fixing nip portion N in such state, the surface condition of the smoothing sheet member 3C is transferred onto the surface of the fixing roller 1, whereby the surface of the fixing roller 1 namely the surface condition of the surface releasing layer 14 is changed. In order to change the surface releasing layer 14, a revolution and a driving time of the fixing roller 1 are suitably selected according to the length of the smoothing sheet member 3C. Also the surface of the fixing roller 1 may be heated to the second set temperature before the smoothing sheet member 3C is introduced into the fixing nip portion N.

After the surface condition is changed, the heater driving circuit 8 is on/off controlled according to the roller surface temperature detected by the temperature detector 7 to control the power supply to the heater 12, thereby gradually lowering the surface temperature of the fixing roller 1 to the temperature area lower than the melting point of the surface releasing layer 14, thus executing a cooling. During this operation, the smoothing sheet member 3C is nipped and conveyed by the fixing nip portion N. In case the rear end of the smoothing sheet member 3C passes through the fixing nip portion N in the course of the cooling step, a line is formed on the surface of the fixing roller 1 by the rear edge of the smoothing sheet member 3C. In order to avoid generation of such unevenness in the surface condition, the smoothing sheet member 3C is required to have a sufficient length in the proceeding direction.

In case of changing the releasing layer 14 from a surface condition corresponding to the roughing sheet member 3C to a surface condition corresponding to the smoothing sheet member 3C, or In case of restoring the releasing layer 14 as in embodiment 1, the process is terminated in the above-described step.

A surface condition roughing step will be explained. FIG. 13 shows a cross-sectional view and a perspective view of the fixing apparatus in the course of the surface condition roughing step.

At first, the roughing sheet member 3D is introduced into the fixing nip portion N. In this state, the fixing roller 1 is rotated by the driving system M in the direction of the arrow (clockwise), and, while the roughing sheet member 3D is passed, the surface of the fixing roller 1 is gradually heated to the second set temperature equal to or higher than the melting point of the surface releasing layer 14 and the heater 12 is so controlled as to maintain this temperature. Thus, by heating the surface releasing layer 14 to a temperature area equal to or higher than the melting point, and by nipping and conveying the roughing sheet member 3D in the fixing nip portion N in such state, the surface condition of the roughing sheet member 3D is transferred onto the surface of the fixing roller 1, whereby the surface of the fixing roller 1 namely the surface condition of the surface releasing layer 14 is changed. In order to change the surface releasing layer 14, a revolution and a driving time of the fixing roller 1 are suitably selected according to the length of the roughing sheet member 3D. Also the surface of the fixing roller 1 may be heated to the second set temperature before the roughing sheet member 3D is introduced into the fixing nip portion N.

After the surface condition of the releasing layer 14 is changed, the heater driving circuit 8 is on/off controlled according to the roller surface temperature detected by the temperature detector 7 to control the power supply to the heater 12, thereby gradually lowering the surface temperature of the fixing roller 1 to the temperature area lower than the melting point of the surface releasing layer 14, thus executing a cooling. During this operation, the roughing sheet member 3D is nipped and conveyed by the fixing nip portion N. In case the rear end of the roughing sheet member 3D passes through the fixing nip portion N in the course of the cooling step, a line is formed on the surface of the fixing roller 1 by the rear edge of the roughing sheet member 3D. In order to avoid generation of such unevenness in the surface condition, the roughing sheet member 3D is required to have a sufficient length in the proceeding direction.

In this manner the surface condition changing operation is terminated.

In the above-described surface condition changing operation, when the cooling is completed, the surface condition of the surface releasing layer 14 of the fixing roller 1 is changed to a desired surface condition by the transfer of the surface condition of the surface condition changing sheet member 3C or 3D.

Also, as in embodiment 2, the smoothing sheet member 3C may be dispensed with by utilizing the pressure roller 2 as a surface smoothing member. Also in case of executing a surface roughing 25 operation, the surface smoothing operation need not necessarily be executed.

In the present embodiment for gloss control, there has been explained a gloss control over the entire image surface, but the gloss control may be executed in a part thereof. For example a partial gloss control allows to record a watermark on the 5 image, by a partial gloss change.

For executing a partial change In the surface condition with a fixing apparatus equipped with a roughing member as in embodiment 7, it is possible to utilize a roughing member having different blast states in the axial direction of the roller and to partially change gloss with such roughing member after a surface smoothing step.

In case of employing a roughing sheet instead of a roughing member in the fixing apparatus as in embodiment 8, a partial gloss change can be achieved, after a surface smoothing step, by passing a roughing sheet member having different surface conditions in the transversal direction (perpendicular to the moving direction of the sheet member) through the fixing nip portion N. It is also possible to change the gloss in a part of the image area, as shown in FIG. 14, by employing a roughing sheet member 3E of a shape to be roughed instead of a rectangular sheet member.

Embodiment 9

Figure 15:
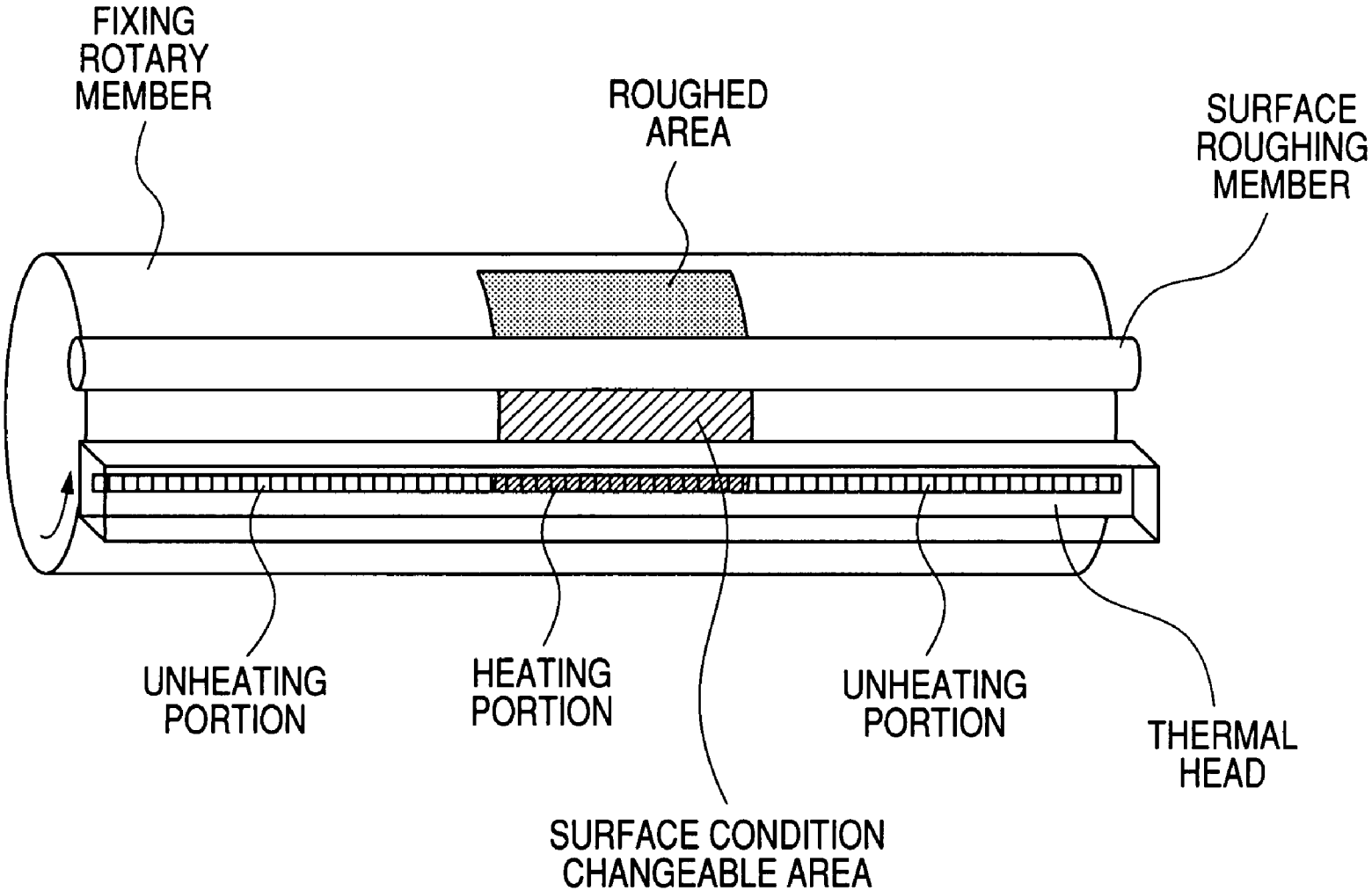
FIG. 15 is a conceptual view showing a surface smoothing step in a fixing apparatus of embodiment 9.
Figure 16:
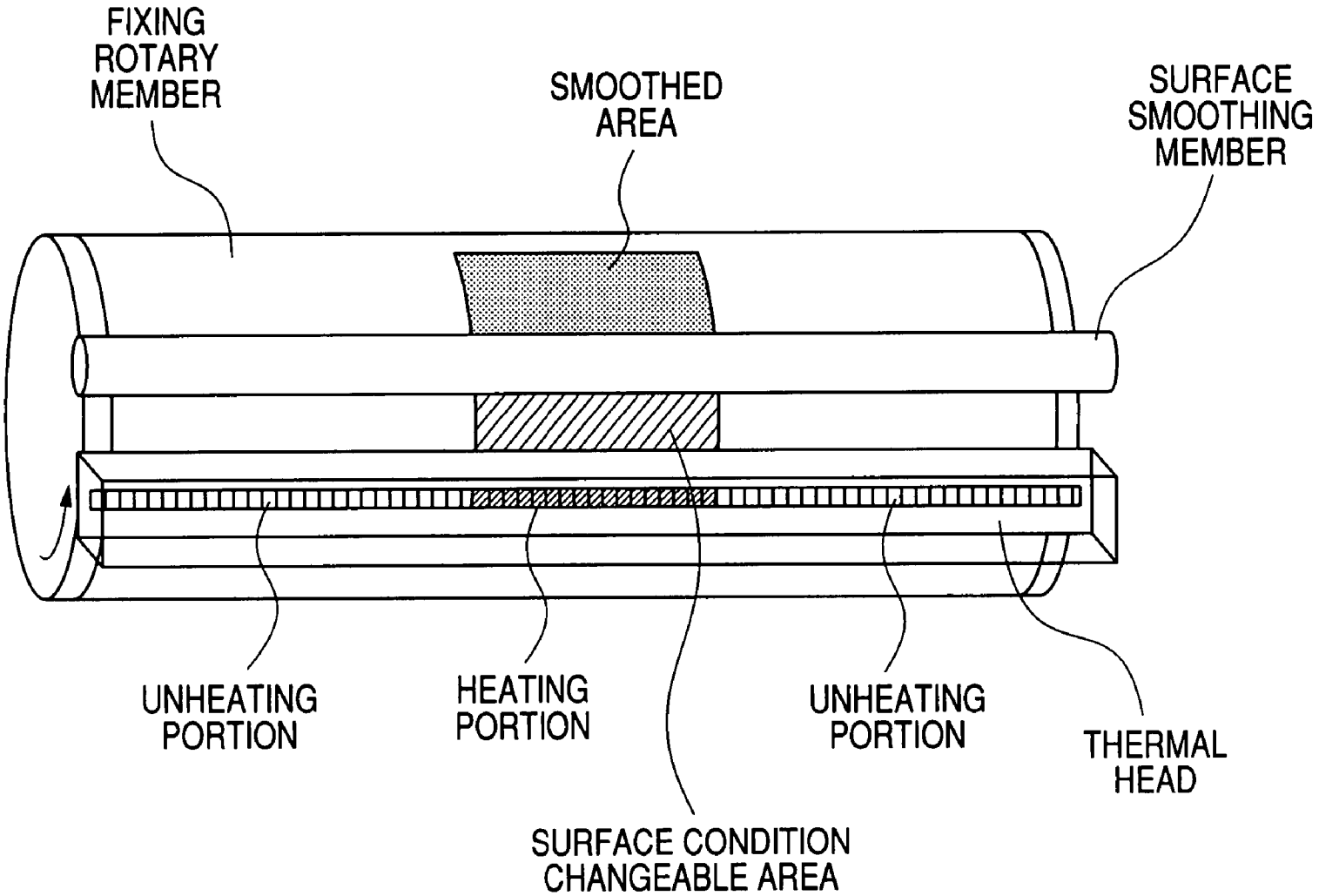
FIG. 16 is a conceptual view showing a surface roughing step in a fixing apparatus of embodiment 9.

FIGS. 15 and 16 are perspective views showing a vicinity of a fixing rotary member capable of changing gloss partially in the axial direction.

In the present embodiment, a heater is provided inside the fixing roller as in embodiment 1 (though not illustrated in FIGS. 15 and 16), and a 5 thermal head is provided in the vicinity of the fixing roller. The thermal head is capable of arbitrarily setting the heat generating area in the axial direction of the fixing roller. At the fixing operation, a toner is fixed by the heater provided In the fixing roller, and, at the surface condition changing operation, the surface layer (releasing layer) of the fixing roller is heated with the thermal head. However, it is also possible to dispense with the heater inside the fixing roller and to execute the fixing operation and the surface condition changing operation by the thermal head only.

As shown in FIGS. 15 and 16, by generating heat only in a central area of the thermal head in the longitudinal direction, a central area only of the fixing roller in the longitudinal direction thereof becomes a surface condition changeable area. Therefore, by contacting a smoothing member or a roughing member with the surface of the fixing roller, the central area of the fixing roller in the longitudinal direction can be made a surface condition different from that of the end areas, whereby the central area alone can be made a high gloss or a low gloss.

Thus, by providing a heater capable of partially heating the surface of the fixing roller, a partial area on the surface of the fixing roller can be given a surface condition different from that In other areas. In case there is provided a heater capable of partially heating the surface of the fixing roller such as a thermal head, a surface smoothing step may be executed after a surface roughing step as shown In FIG. 16. For example, it is possible to execute a surface roughing step on the entire surface of the fixing roller, then to generate heat in a part of the thermal head thereby forming a surface condition changeable area, and to smooth such area with a smoothing member or a smoothing sheet. In this manner, a partial change of the surface condition can be achieved even by inverting the order of the surface roughing step and the surface smoothing step.

In the fixing apparatuses of embodiments 7–9, a change in the gloss setting merely varies the state of surface irregularities of the toner image after the fixation, and scarcely changes a toner fusing state, a transparency of the toner image after fixation and a level of toner mixing. Thus, there can be provided an advantage of increasing the regulating range of the gloss without sacrificing the color reproducibility of the output image.

The foregoing embodiments have been explained on a fixation of a recording material P bearing an unfixed toner image t, but the present invention is not limited to such case. For example, the present invention may be employed in a re-fixing apparatus for re-fixing of a recording material P after fixation or temporary fixation of a toner image, or in a fixing device exclusive for gloss control.

It is more preferable to employ a belt-shaped or film-shaped fixing rotary member in place for the fixing roller 1 and to provide a cooled separation function of separating the recording material from the fixing rotary member after the recording material is cooled after passing the nip portion, thereby achieving more faithful transfer of the surface condition of the fixing rotary member onto the surface of the toner image.

Also the fixing apparatus of the present invention may be provided with a control for smoothing the entire surface of the fixing rotary member. Such control allows to form an image of a photographic gloss.

The surface condition changing member provided in the fixing apparatus is not limited to a roller shaped member, and a roughing member may be constituted, for example, of a dot impact head.

In the foregoing embodiments, there have been explained apparatus and method of pressurization under heating with a heat roll (fixing roller) as an operation of fixing an unfixed toner image on a recording material, but the present invention is not limited to such case but includes all the fixing rotary members having a surface releasing layer. For example it can be a belt-shaped or film-shaped rotary member having an elastic layer, and the effect of the present invention is not reduced even in a film shaped rotary member without an elastic layer or a rigid roller without an elastic layer.

This application claims priority from Japanese Patent Application Nos. 2004-044505 filed on Feb. 20, 2004 and 2005-034838 filed on Feb. 10, 2005, which are hereby incorporated by reference herein.

What is claimed is:

1. An image fixing apparatus for fixing a toner image formed on a recording material, comprising:

a rotatable member;

a heater for heating said rotatable member; and control means which controls a heat generation of said heater;

wherein the toner image on the recording material is heated by said rotatable member;

said apparatus has a surface condition changing mode for changing a surface condition of said rotatable member; and, in case the surface condition changing mode is set, said control means controls the heat generation of said heater in such a manner that a surface temperature of said rotatable member becomes a temperature equal to or higher than a melting point of a surface layer of said rotatable member.

2. An image fixing apparatus according to claim 1, wherein said control means controls the heat generation of said heater so that the surface temperature of said rotatable member is maintained at a set temperature, said control means is capable of setting a first set temperature higher than a melting point of the toner but lower than the melting point of the surface layer of said rotatable member, and a second set temperature equal to or higher than the melting point of the surface layer of said rotatable member, and the second set temperature is set when the surface condition changing mode is set.

3. An image fixing apparatus according to claim 1, further comprising a surface condition changing member for changing the surface condition of said rotatable member, wherein the surface condition of said rotatable member is changed by a transfer of a surface condition of said surface condition changing member onto the surface of said rotatable member in a state where the surface of said rotatable member is heated to a temperature equal to or higher than the melting point of the surface layer of said rotatable.

4. An image fixing apparatus according to claim 3, wherein said surface condition changing member is movable between a position in contact with the surface of said rotatable member and a position spaced from the surface of said rotatable member.

5. An image fixing apparatus according to claim 3, wherein said surface condition changing member is a pressure roller which forms, in cooperation with said rotatable member, a nip portion for nipping and conveying the recording material.

6. An image fixing apparatus according to claim 3, wherein said surface condition changing member is a smoothing member having a smooth surface.

7. An image fixing apparatus according to claim 3, wherein said surface condition changing member is a smoothing member and a roughing member having a surface rougher than said smoothing member.

8. An image fixing apparatus according to claim 3, wherein said surface condition changing member has a variable contact pressure to said rotatable member.

9. An image fixing apparatus according to claim 1, further comprising a pressure roller for forming, in cooperation with said rotatable member, a nip portion for nipping and conveying the recording material.

10. An image fixing apparatus according to claim 1, wherein the surface condition of said rotatable member is changed by passing a surface condition changing sheet member through said apparatus in a state where the surface of said rotatable member is heated to a temperature equal to or higher than the melting point of the surface layer of said rotatable member, thereby transferring a surface condition of the sheet member onto the surface of said rotatable member.

11. An image fixing apparatus according to claim 1, wherein the surface layer of said rotatable member has a melting point of 250° C. or lower.

12. An image fixing apparatus according to claim 1, wherein said heater is positioned inside said rotatable member.

13. An image fixing apparatus according to claim 1, wherein said heater is positioned adjacent to an external periphery of said rotatable member.

14. An image fixing apparatus according to claim 13, wherein said heater is capable of arbitrarily setting a heat generation area in a longitudinal direction of said rotatable member.

15. A fixing rotary member for use in a fixing apparatus for heat fixing a toner image formed on a recording material, comprising:

a base layer; and a surface layer;

wherein said surface layer is constituted of a thermoplastic resin with a melting point equal to or lower than 250° C.

16. A fixing rotary member according to claim is claim 15, wherein said surface layer has a melting point higher than a melting point of the toner.

* * * * *

UNITED STATES PATENT AND TRADEMARK OFFICE

CERTIFICATE OF CORRECTION

PATENT NO. : 7,224,922 B2
APPLICATION NO. : 11/058253
DATED : May 29, 2007
INVENTOR(S) : Kazuhisa Kemmochi It is certified that error appears in the above-identified patent and that said Letters Patent is hereby corrected as shown below:

COLUMN 2
Line 26, “25 reS1n” should read --resin--.

COLUMN 5
Line 5, “a” should be deleted.

COLUMN 6
Line 42, “25” should be deleted.
Line 44, “toner/but” should read --toner, but--.

COLUMN 7
Line 20, “In” should read --in--.
Line 36, “thin” should read --than--.
Line 42, “In” should read --in--.

COLUMN 9
Line 7, “surfaced” should read --surface--.

COLUMN 10
Line 43, “on” should read --of--.

COLUMN 14
Line 32, “In” should read --in--.
Line 66, “In” should read --in--.

COLUMN 15
Line 37, “contacting” should read --contact--.
Line 52, “In” should read --in--.
Line 54, “25” should be deleted.

COLUMN 16
Line 17, “roughing member 38” should read --roughing member 3B--.
Line 20, “38” should read --3B--.
Line 30, “In” should read --in--.
Line 37, “In” should read --in--.
Line 55, “pint” should read --point--.

COLUMN 18
Line 20, “In” should read --in--.
Line 54, “15” should be deleted.
Line 66, “38;” should read --3B.--.

UNITED STATES PATENT AND TRADEMARK OFFICE

CERTIFICATE OF CORRECTION

PATENT NO. : 7,224,922 B2
APPLICATION NO. : 11/058253
DATED : May 29, 2007
INVENTOR(S) : Kazuhisa Kemmochi It is certified that error appears in the above-identified patent and that said Letters Patent is hereby corrected as shown below:

COLUMN 19
Line 5, “38” should read --3B--.
Line 13, “38” should read --3B--.
Line 18, “38” should read --3B--.
Line 38, “20” should be deleted.
Line 51, “surfaced” should read --surface--.

COLUMN 20
Line 20, “surface,” should read --surface--.
Line 40, “In” should read --in--.

COLUMN 21
Line 20, “In” should read --in--.

COLUMN 22
Line 15, “In” should read --in--.
Line 39, “5” should be deleted.
Line 43, “In” should read --in--.

COLUMN 24
Line 24, “rotatable” should read --rotatable member--.

COLUMN 26
Line 4, “claim is” should be deleted.

Signed and Sealed this

Third Day of June, 2008

JON W. DUDAS
*Director of the United States Patent and Trademark Office*